US005296050A

United States Patent [19]

Takamiya et al.

[11] Patent Number: 5,296,050

[45] Date of Patent: Mar. 22, 1994

[54] METHOD OF PRODUCING GRAIN ORIENTED SILICON STEEL SHEETS HAVING IMPROVED MAGNETIC PROPERTIES

[75] Inventors: Toshito Takamiya; Masahiko Manabe; Fumihiko Takeuchi; Takashi Obara, all of Chiba; Yoshiaki Iida, Kobe, all of Japan

[73] Assignee: Kawasaki Steel Corporation, Japan

[21] Appl. No.: 925,310

[22] PCT Filed: May 8, 1990

[86] PCT No.: PCT/JP90/00586

§ 371 Date: Jan. 7, 1991

§ 102(e) Date: Jan. 7, 1991

[87] PCT Pub. No.: WO90/13673

PCT Pub. Date: Nov. 15, 1990

Related U.S. Application Data

[63] Continuation of Ser. No. 634,202, Jan. 7, 1991, abandoned.

[30] Foreign Application Priority Data

May 8, 1989 [JP] Japan ..... 1-113643
May 16, 1989 [JP] Japan ..... 1-120337
Oct. 2, 1989 [JP] Japan ..... 1-255260

[51] Int. Cl.[5] ..... C21D 9/46

[52] U.S. Cl. ..... 148/111; 148/112; 148/504

[58] Field of Search ..... 148/110, 111, 112, 504

[56] References Cited

U.S. PATENT DOCUMENTS 4,204,891 5/1980 Shiozaki et al. ..... 148/111
4,302,257 11/1981 Matsumoto et al. ..... 148/111
4,437,909 3/1984 Mori et al. ..... 148/111
4,473,416 9/1984 Kawamo et al. ..... 148/111
5,039,359 8/1991 Yoshitomi et al. ..... 148/111

FOREIGN PATENT DOCUMENTS 0118326 9/1979 Japan .
61-12822 1/1986 Japan .
1084327 4/1986 Japan .

*Primary Examiner*—R. Dean
*Assistant Examiner*—Sikyin Ip
*Attorney, Agent, or Firm*—Austin R. Miller

[57] ABSTRACT

This invention not only improves the formation of fine crystal structure and hence the magnetic properties as well as surface properties while utilizing the merits of the hot strip mill at maximum by conducting the rough rolling in the steps for the production of grain oriented silicon steel sheets, particularly hot rolling step at a high temperature and a large draft, but also stably achieves the more improvement of the magnetic properties under a high reliability by accurately controlling the precipitation state of inhibitor at a finish rolling stage in the hot rolling step.

7 Claims, 9 Drawing Sheets

METHOD OF PRODUCING GRAIN ORIENTED SILICON STEEL SHEETS HAVING IMPROVED MAGNETIC PROPERTIES

This application is a continuation of application Ser. No. 07/634,202, filed Jan. 7, 1991, now abandoned.

TECHNICAL FIELD

This invention relates to a method of producing grain oriented silicon steel sheets having improved magnetic properties.

1. Background of the Invention

As is well-known, grain oriented silicon steel sheets are mainly used as a material for iron core in transformers and other electrical machinery and equipment and are comprised of secondary recrystallized grains aligned {110} face to plate face and <001> axis to rolling direction. In order to develop the secondary recrystallized grains having such a crystal orientation, it is required that precipitates such as MnS, MnSe, AlN and the like called as an inhibitor are uniformly and finely dispersed in steel to effectively suppress growth of crystal grains in an orientation other than {110}<001> orientation during the final annealing at a high temperature. Therefore, the control of the inhibitor dispersed state is carried out by solid-soluting these precipitates in the slab heating prior to hot rolling at once and then subjecting to a hot rolling having a proper cooling pattern.

Here, an important role of the hot rolling lies in that the solid-soluted inhibitor components are finely and uniformly precipitated as an inhibitor.

2. Description of the Prior Art

For example, Japanese Patent laid open No. 53-39852 has reported that a proper dispersion phase of MnSe is obtained by holding the steel sheet within a temperature range of not lower than 850° C. but not higher than 1200° C. for 60–360 seconds. In this method, however, the inhibitor is ununiform and coarsely precipitated in a fair frequency. Particularly, it is experientially known that the inhibitor becomes considerably coarse when being held at about 1100° C. for a long period of time. Therefore, this method is difficult to provide a complete secondary recrystallized structure because the inhibiting force of the inhibitor decreases.

Furthermore, Japanese Patent Application Publication No. 58-13606 has proposed a method wherein the steel sheet is cooled at a cooling rate of not less than 3° C./s while being continuously subjected to a hot rolling within a temperature range of 950°–1200° C. at a draft of not less than 10%. In this method, however, the inhibitor is not always finely precipitated, and the coarse or nonuniform precipitation of the inhibitor is caused in accordance with the size of crystal grains. Particularly, the dispersion in a direction of sheet thickness is apt to become nonuniform. As a cause, there is mentioned a nonuniformity of strain inherent to high temperature deformation.

In these conventional methods, the dispersed state of the inhibitor can not completely be rendered into a fine and uniform state, and the normal growth of primary crystal grains can not effectively be controlled at a secondary recrystallization annealing step in final finish annealing, so that the complete secondary recrystallization structure can not be obtained.

Another important role of the hot rolling lies in that the slab cast structure is made fine by recrystallization to form a structure most suitable for secondary recrystallization. Moreover, such a treatment for increasing the fineness of the crystal structure has hitherto been carried out apart from the solid solution treatment of the inhibitor.

As to the solid solution of the inhibitor, it has hitherto been reported, for example, in Japanese Patent laid open No. 63-10911 that grain oriented silicon steel sheets having less surface defect and good properties are obtained by raising the slab surface temperature above 1320° C. to a temperature of 1420°–1495° C. at a temperature rising rate of not less than 8° C./min when holding the slab surface temperature within a range of 1420°–1495° C. for 5–60 minutes. According to this method, the complete solid solution of the inhibitor has certainly be achieved and also the coarsening of the slab surface grains can be suppressed in principle to improve the surface properties, but it is actually difficult to uniformly satisfy the above condition against a heavy article such as a slab or the like, and particularly it is impossible in fact to completely suppress the coarsening of crystal grains over the full length of the slab. Therefore, in order to ensure the uniformity of the structure, it is required to add any treatment for finely dividing the crystal grains during the hot rolling.

On the other hand, as to the formation of fine structure, there are known many methods, i.e. a method of rolling under a high draft through recrystallization within a temperature range of 1190°–960° C. (Japanese Patent laid open No. 54-120214), a method of rolling under a high draft of not less than 30% at a state containing not less than 3% of $\gamma$-phase within a temperature range of 1230°–960° C. (Japanese Patent laid open No. 55-119216), a method of restricting a starting temperature for rough rolling to not higher than 1250° C. (Japanese Patent laid open No. 57-11614), a method of rolling at a strain rate of not more than 15 $s^{-1}$ and a draft of not less than 15%/one pass within a temperature range of 1050°–1200° C. (Japanese Patent laid open No. 59-93828), and the like. These methods are common in a point that the formation of fine structure is carried out by rolling under a high draft at a temperature region of about 1200° C. That is, they are based on recrystallization limits reported in "Tetsu-to-Hagane", 67 (1981) S 1200 or is based on the same technical idea as described above. FIG. 4 shows this knowledge. From this figure, it is understood that the rolling at high temperature does not substantially contribute to the recrystallization and only the application of large strain at a low temperature recrystallization region contributes to the recrystallization. Therefore, it is necessary to conduct the rolling after the cooling to not higher than 1250° C. in order to form the fine structure through the recrystallization even in the slab heated to high temperature.

In all of the above techniques, the heating temperature is not lower than 1250° C., and the upper limit thereof is not particularly restricted, so that it is common in a point that the inhibitor is solid-soluted by holding in a furnace for a long period of time while allowing the grain growth of the slab to a certain extent and the crystal grains are finely divided by hot rolling.

Considering the actual state of these method, however, when the slab is heated at a high temperature for completely solid-soluting the inhibitor, it is required to not only arrange a cooling means at an upstream side of hot strip mill but also take an extra mill power for conducting the hot rolling at a low temperature, which is conflicting with the idea of hot strip mill aiming at the energy-saving and the high productivity. Furthermore, the effect of the rolling at the low temperature is not necessarily clear.

That is, when the above method is applied to actual steps, many problems are existent though the effect, is developed to a certain extent.

OBJECTS OF THE INVENTION

A first object of the invention is to provide a method of advantageously producing grain oriented silicon steel sheets, in which improved magnetic properties are stably obtained by conducting sufficiently uniform and fine dispersion of the inhibitor at the hot rolling step.

A second object of the invention is to provide a method of advantageously producing grain oriented silicon steel sheets having improved magnetic properties and further surface properties, in which a fine and uniform crystal structure is reliably obtained while utilizing mass production as a merit of hot strip mill at maximum even under a condition of high-temperature slab heating useful for the complete solid-solution of the inhibitor and the improvement of surface properties.

SUMMARY OF THE INVENTION

The feature and construction of the invention are as follows. 1. A first embodiment includes a method of producing a grain oriented silicon steel sheet having improved magnetic properties by a series of steps of subjecting a slab of silicon-containing steel to hot rolling comprised of rough rolling and subsequent finish rolling after heating, subjecting to a heavy cold rolling or a two-times cold rolling through an intermediate annealing to a final sheet thickness, subjecting to decarburization annealing, applying a slurry of an annealing separator to a surface of a steel sheet, and subjecting to a final finish annealing, characterized in that at the above hot rolling step, said finish rolling is carried out at a draft of not less than 40% within a temperature range of 1000°–850° C. followed to said rough rolling within a temperature region exceeding 1150° C., and the above temperature range is held for 2–20 seconds. 2. A second embodiment includes a method of producing a grain oriented silicon steel sheet having improved magnetic properties by a series of steps of subjecting a slab of silicon-containing steel to hot rolling comprised of rough rolling and subsequent finish rolling after heating, subjecting to a heavy cold rolling or a two-times cold rolling through an intermediate annealing to a final sheet thickness, subjecting to decarburization annealing, applying a slurry of an annealing separator to a surface of a steel sheet, and subjecting to a final finish annealing, characterized in that at said finish rolling stage in the above hot rolling step, said steel sheet is cooled while holding the temperature in a central portion of said steel sheet in the thickness direction above 1150° C., and when a temperature positioned from the surface into a depth corresponding to 1/20 of the sheet thickness reaches to a temperature range of 1000°–950° C., the steel sheet is rolled at a draft of not less than 40% and held at the above temperature range for 3–20 seconds and then cooled, and when a temperature at the central portion reaches to a temperature range of 950°–850° C., the steel sheet is rolled at a draft of not less than 40% and held at this temperature range for 2–20 seconds. 3. A third embodiment includes a method of producing a grain oriented silicon steel sheet having improved magnetic properties by a series of steps of subjecting a slab of silicon-containing steel to hot rolling comprised of rough rolling and subsequent finish rolling after heating, subjecting to a heavy cold rolling or a two-times cold rolling through an intermediate annealing to a final sheet thickness, subjecting to decarburization annealing, applying a slurry of an annealing separator to a surface of a steel sheet, and subjecting to a final finish annealing, characterized in that at said rough rolling stage in said hot rolling step, a first pass is carried out under conditions that a rolling temperature $T_1$ is not lower than 1280° C. and a draft $R_1$ satisfies the following equation:

$$60 \geqq R_1(\%) \geqq 0.5T_1 + 670$$

and held under the above conditions up to a next pass for not less than 30 seconds, and a final pass is carried out under conditions that a rolling temperature $T_2$ is not lower than 1200° C. and a draft $R_2$ satisfies the following equation:

$$70 \geqq R_2(\%) \geqq 0.1T_2 + 165$$

4. A fourth embodiment includes a method of producing a grain oriented silicon steel sheet having improved magnetic properties by a series of steps of subjecting a slab of silicon-containing steel to hot rolling comprised of rough rolling and subsequent finish rolling after heating, subjecting to a heavy cold rolling or a two-times cold rolling through an intermediate annealing to a final sheet thickness, subjecting to decarburization annealing, applying a slurry of an annealing separator to a surface of a steel sheet, and subjecting to a final finish annealing, characterized in that at said rough rolling stage in said hot rolling step, a first pass is carried out under conditions that a rolling temperature $T_1$ is not lower than 1280° C. and a draft $R_1$ satisfies the following equation:

$$60 \geqq R_1(\%) \geqq 0.5T_1 + 670$$

and held under the above conditions up to a next pass for not less than 30 seconds, and a final pass is carried out under conditions that a rolling temperature $T_2$ is not lower than 1200° C. and a draft $R_2$ satisfies the following equation:

$$70 \geqq R_2(\%) \geqq 0.1T_2 + 165$$

and then said finish rolling is carried out within a temperature range of 1000°–850° C. at a draft of not less than 40% and held at this temperature range for 2–20 seconds.

5. A fifth embodiment includes a method of producing a grain oriented silicon steel sheet having improved magnetic properties by a series of steps of subjecting a slab of silicon-containing steel to hot rolling comprised of rough rolling and subsequent finish rolling after heating, subjecting to a heavy cold rolling or a two-times cold rolling through an intermediate annealing to a final sheet thickness, subjecting to decarburization annealing, applying a slurry of an annealing separator to a surface of a steel sheet, and subjecting to a final finish annealing, characterized in that at said rough rolling stage in said hot rolling step, a first pass is carried out under conditions that a rolling temperature $T_1$ is not lower than 1280° C. and a draft $R_1$ satisfies the following equation:

$$60 - R_1(\%) \geqq 0.5T_1 + 670$$

and held under the above conditions up to a next pass for not less than 30 seconds, and a final pass is carried out under conditions that a rolling temperature $T_2$ is not lower than 1200° C. and a draft $R_2$ satisfies the following equation:

$$70 \geqq R_2(\%) \geqq -0.1T_2 165$$

and at said subsequent finish rolling stage, said steel sheet is cooled while holding the temperature in a central portion of said steel sheet in the thickness direction above 1150° C., and when the temperature positioned from the surface into a depth corresponding to 1/20 of the sheet thickness reaches to a temperature range of 1000°-950° C., the steel sheet is rolled at a draft of not less than 40% and held at the above temperature range for 3-20 seconds and then cooled, and when a temperature at the central portion reaches to a temperature range of 950°-850° C., the steel sheet is rolled at a draft of not less than 40% and held at this temperature range for 2-20 seconds.

6. A sixth embodiment includes a method of producing a grain oriented silicon steel sheet in the first, second, third, fourth and fifth inventions, wherein a temperature of heating said slab is not lower than 1370° C. as a temperature in a central portion of said slab.

DETAILED DESCRIPTION OF THE INVENTION

The invention will be described with respect to experimental results succeeding in each of these inventions below.

At first, the experimental results on a uniform and fine dispersion of an inhibitor will be described.

In general, when an element forming an inhibitor such as Se or the like is precipitated and grown as MnSe or the like at a cooling stage after the solid solution treatment, it has been proposed to control the size and average interval of precipitated grains by the cooling rate, holding temperature and holding time. However, the detail of precipitation behavior required for the above control in the hot rolling is not substantially clear up to the present, and particularly the relationship between hot strain and precipitation of inhibitor is not clear, so that the inhibitor could not uniformly and finely be precipitated over a full surface of the steel sheet.

On the contrary, the inventors have made various studies with respect to the precipitation behavior of the inhibitor at various temperature regions and found out that the precipitation behavior of inhibitor largely changes in accordance with the strain quantity applied at a high temperature and the holding time of this temperature.

The inventors have made an experiment in a laboratory wherein Se was completely solid-soluted by heating a steel slab and then strain was applied at each temperature region and this temperature was held for a given time. In this case, the strain quantity was varied by adopting a draft of 0-70% and also the holding time was varied. From this experiment, it was understood that the precipitation behavior of the inhibitor, in which the precipitation rate was increased by applying strain, was entirely different from a case of applying no strain. That is, the experiment of applying no strain is unsuitable for investigating the precipitation of inhibitor in the hot rolling. Furthermore, it has been found that when the sheet was once cooled to room temperature at the cooling stage before the precipitation treatment, the behavior was largely different from that in the original cooling stage. Therefore, the experiment was carried out by applying a proper hot working strain under an accurate heat cycle.

An example of the experiments succeeding in the first embodiment of the invention will be described below.

A slab of silicon steel comprising C: 0.045 wt% (hereinafter shown by % simply), Si: 3.25%, Mn: 0.07%, Se: 0.020% and the reminder being substantially Fe and having a thickness of 30 mm was subjected to a solid solution treatment at 1350° C. for 30 minutes and rapidly cooled to a temperature giving a hot working strain, and then strain was applied by rolling at a draft of 50% and held at the above temperature for varied times.

Figure 1:
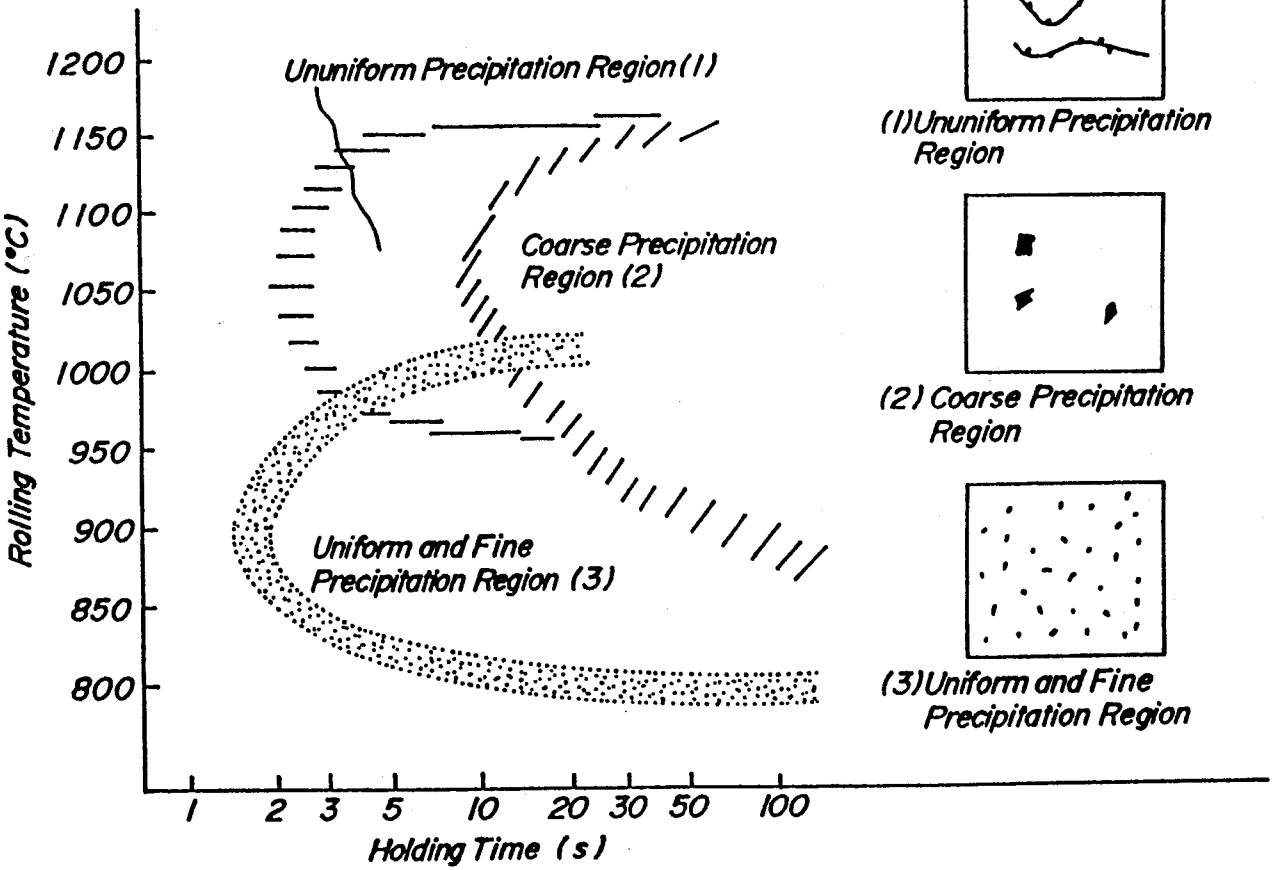
FIG. 1 is a diagram showing influence of rolling temperature and holding time on the precipitation state of an inhibitor.

In FIG. 1 is shown results examined on influences of each rolling temperature exerting on the precipitation state of inhibitor and each holding time at such a temperature.

Moreover, when the sheet is treated in the same cooling pattern without applying strain, no precipitation of the inhibitor is caused until the holding time is 60 seconds, so that the effect by the application of strain is very large, and it has been confirmed that the introduction of strain is indispensable for the precipitation of inhibitor in the hot rolling.

From FIG. 1, it is clear that the nonuniform and coarse precipitation is caused by applying strain at a temperature region exceeding 1000° C. However, no precipitation of inhibitor is caused when the temperature exceeds 1150° C.

On the contrary, the inhibitor is finely and uniformly precipitated at the temperature region of 1000°-850° C., and in this case it has been confirmed that the holding time of not less than 2 seconds is required. However, when the holding time is too long, the precipitated size of the inhibitor becomes larger, which produces the reduction of the controlling force. Therefore, a holding time exceeding 20 seconds is not favorable.

Furthermore, it has been found from FIG. 1 that the inhibitor is nonuniformly and coarsely precipitated at high temperature, while the inhibitor is uniformly and finely precipitated at low temperature side as shown by the nonuniform precipitation region (1), coarse precipitation region (2) and uniform and fine precipitation region (3).

As shown by a schematic view (1) of FIG. 1, the precipitation behavior at high temperature is understood to center the precipitation onto dislocations introduced by hot working strain and be influenced by the dislocation density inside crystal. For this end, the inhibitor is apt to precipitate on grain boundaries and subgrain boundaries, and the uniform precipitation in the grains hardly occurs. On the contrary, the precipitation behavior at low temperature as shown by a schematic view (3) is caused irrespective of dislocations inside grain, so that the precipitation becomes uniform inside the grains. The precipitation behavior at low temperature is considered to be precipitation onto lattice defects introduced by working strain, which is more uniform and finer than the precipitation onto the dislocations observed at high temperature, so that the inhibitor is uniformly and finely precipitated over a full surface of the steel sheet. In this point, the feature that the precipitation onto the dislocations becomes large at a high temperature is considered due to the fact that the lattice defects introduced during working rapidly dislocates and moves onto subgrain boundaries and grain boundaries at the high temperature.

The quantity of hot working strain required is approximately a quantity introduced by rolling at a cumulative draft of not less than 40% within the above temperature range. This is because, the strain quantity introduced into the crystal grains of the steel sheet actually differs in every grain, so that the difference in the strain quantity between the grains becomes large at a light draft and there is largely caused a fear of differing the dispersion precipitation state of the inhibitor every grain.

The following has been found from the above experimental results.

That is, when the hot strain is applied at a temperature region of 1000°-850° C., the precipitation nucleus of inhibitor is formed at a very fast speed over the full surface inside the grain, and also the precipitation is completed by holding at this temperature range for 2-20 seconds, in which the dispersion state of the inhibitor in the crystal grains becomes fine and uniform. That is, the completely fine and uniform precipitation of the inhibitor is achieved over the full surface of the steel sheet, and hence products having very excellent magnetic properties are obtained.

The second embodiment of the invention will be described below.

Although the uniform and fine dispersion of the inhibitor is achieved by the aforementioned treatment, when the surface state of the steel sheet changes in accordance with the change of annealing temperature at subsequent step of hot rolling, for example, at a primary recrystallization annealing step, the inhibitor existing in the vicinity of the surface is apt to become unstable. Therefore, in order to stably produce the product having improved magnetic properties in industrial scale, it has been found that it is required to minutely control the dispersion precipitation state of the inhibitor in the direction of sheet thickness.

The inventors have made studies on the results shown in FIG. 1 in detail and found that slightly large inhibitor is obtained at the high temperature even in the uniform precipitation region. That is, it has been found that when strain is applied at a temperature region of 1000°-950° C. and this temperature region is held for not less than 3 seconds, uniform but slightly large inhibitor is obtained. This is considered due to the fact that even in the uniform precipitation region, the high temperature side is less in the place forming nucleus for the starting of precipitation and fast in the diffusion so that the inhibitor somewhat grows as compared with the low temperature side.

Therefore, the size of the inhibitor can be controlled by utilizing the above behavior.

As a result of examinations on the stabilization of inhibitor near to the surface, it has been confirmed that when the size of the inhibitor near to the surface is made somewhat large, the change of the inhibitor component such as decomposition due to diffusion from the surface or the like at the post step hardly occurs. Concretely, when the temperature of a layer positioned from the surface to a depth corresponding to 1/20 of the sheet thickness (hereinafter referred to as 1/20 layer) is within a range of 1000°-950° C., the best result is found to be obtained by applying strain and then holding this temperature range for 3-20 seconds. Thus, as the temperature at 1/20 layer and the precipitation state of inhibitor near to the surface can be confirmed to be interrelated, it has been clarified that the precipitation of the inhibitor near to the surface can also be controlled by controlling the temperature at the 1/20 layer.

In brief, in order to finely and uniformly precipitate the inhibitor, the application of working strain at the temperature region of 950°-850° C. is sufficient, while in order to uniformly precipitate slightly large inhibitor, it is enough to apply the working strain at the temperature region of 1000°-950° C.

Therefore, it is possible to separately control the dispersion state of the inhibitor in the vicinity of the surface and the central portion by using the above means, and the controlling force can stably be maintained in the secondary recrystallization annealing without changing the surface inhibitor in the primary recrystallization annealing and the decarburization annealing.

In the actual hot rolling step, the slab is heated by gas and then the temperature in the central portion of the slab is raised above 1370° C. in an induction heating furnace to sufficiently ensure a temperature difference to the surface and completely solid-solute the inhibitor component, and thereafter the silicon steel sheet is cooled with water at the sheet bar stage in the rough rolling to further adjust the surface and central temperatures.

Then, when the temperature near to the surface or temperature located in the layer corresponding to 1/20 of the sheet thickness is within a range of 1000°-950° C. while holding the temperature in the central portion of the sheet above 1150° C. during the finish rolling, the working strain is applied at a draft of not less than 40% and subsequently the above temperature range is held for 3-20 seconds. Further, when the temperature in the central portion is within a range of 950°-850° C. by cooling with water, the working strain is applied at a draft of not less than 40% and the holding time at this temperature range is held to 2–20 seconds to complete the hot finish rolling.

Figure 2:
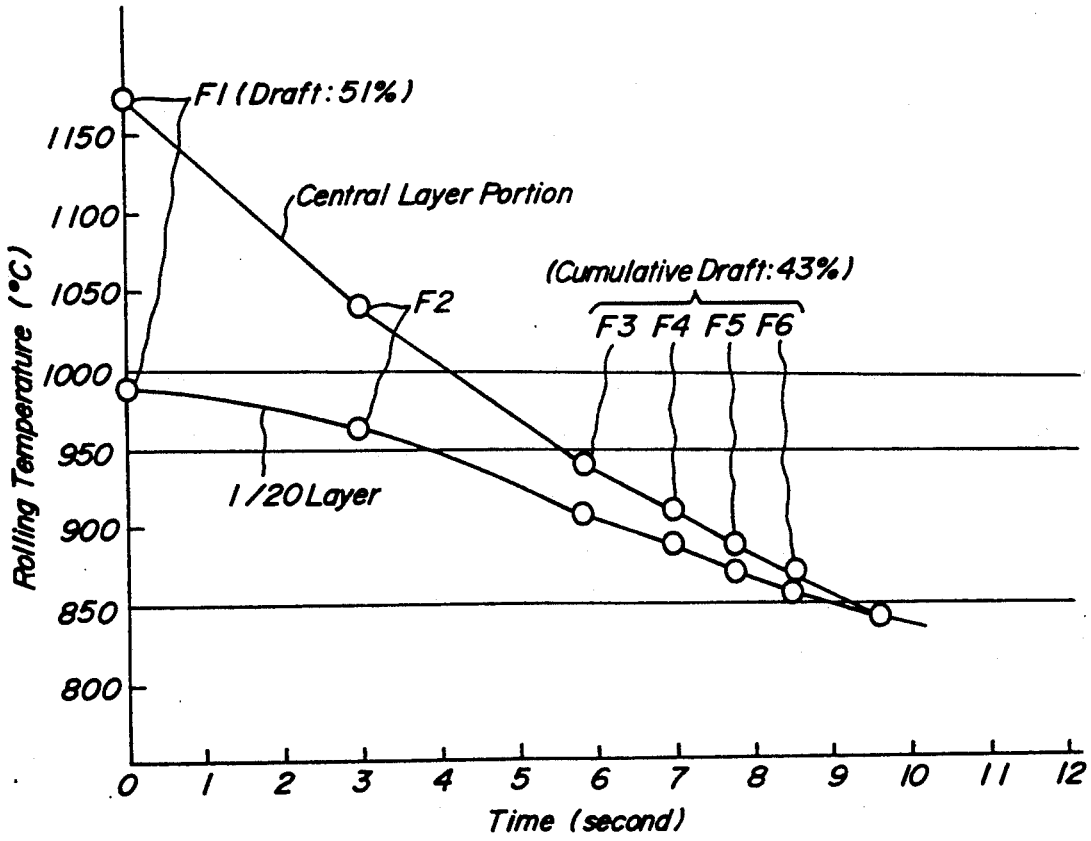
FIG. 2 is a schematic view showing a preferable embodiment of heat hysteresis for carrying out a second embodiment of the invention.

FIG. 2 shows a preferable example of temperature hystresis in the finish rolling. Moreover, the temperatures at the 1/20 layer and the central layer were accurately simulated by means of a computer using finite element method.

That is, when the temperature of the central portion is not lower than 1150° C. and the temperature of the 1/20 layer is slightly lower than 1000° C., a first pass of the finish rolling is carried out to ensure the holding time of at least 3 seconds until the temperature of the 1/20 layer is lower than 950° C. Moreover, the rolling may further be made during such a holding. Then, when the temperature of the central portion is within a temperature range of 950°–850° C., the rolling is carried out at a draft in total of not less than 40%. Moreover, the rolling may be one pass or plural passes. In brief, the draft of not less than 40% may be applied at each of the above temperature ranges.

According to the invention, it is important that the difference in the temperature between the surface layer and the central portion just before the finish rolling is sufficiently held. For this end, it is preferable to sufficiently raise the temperature of the central portion by induction heating. In order to ensure the difference in the temperature between the central portion and the surface layer portion, it is favorable that the surface layer portion is positively cooled with water at the sheet bar stage.

The details elucidating the third embodiment of the invention will be described below.

As previously mentioned, the achievement of formation of fine crystal grains at higher temperature region is very useful for utilizing the mass production as a merit of the hot strip mill.

Further, the inventors have made many experiments and studies on recrystallization behavior at the high temperature region and newly found that the recrystallization fully proceeds when the strain quantity is sufficiently large even at the high temperature region which has hitherto been considered as a strain recovering region and was not interest. In this point, there is no report up to the present. Because, the high temperature heating was difficult in industry, and even when being examined in a laboratory, it was required to conduct the high temperature heating for high temperature rolling, but there were caused problems such as scale formation, repairing of experimental furnace and the like and such a high temperature heating was very difficult.

Moreover, there are many experimental reports on ordinary steels. In this case, the high temperature region above 1200° C. is a dynamic restoring region and is mainly restoring or dynamic recrystallization, so that the examination exceeding these reports has not sufficiently been made. Particularly, almost of the grain oriented silicon steels are $\alpha$-phase because they contain about 3% of Si. Since the $\alpha$-phase is considered to be easily restored, it seems that the dynamic recrystallization does not occur in the grain oriented silicon steel, which is entirely outside the interesting object.

However, the inventors have a question on such a common view and developed a high temperature furnace capable of heating at a superhigh temperature and having a less influence of scale and made various studies using such a high temperature furnace, and as a result the aforementioned results have been first accomplished.

The experiment succeeding in this invention will be described below.

A slab of silicon steel comprising C: 0.04%, Si: 3.36%, Mn: 0.05%, Se: 0.022% and the reminder being substantially Fe was heated at 1350° C. for 30 minutes, rolled at various temperatures under various drafts through one pass and cooled with water, and thereafter the sectional structure was observed to measure a recrystallinity.

Figure 3:
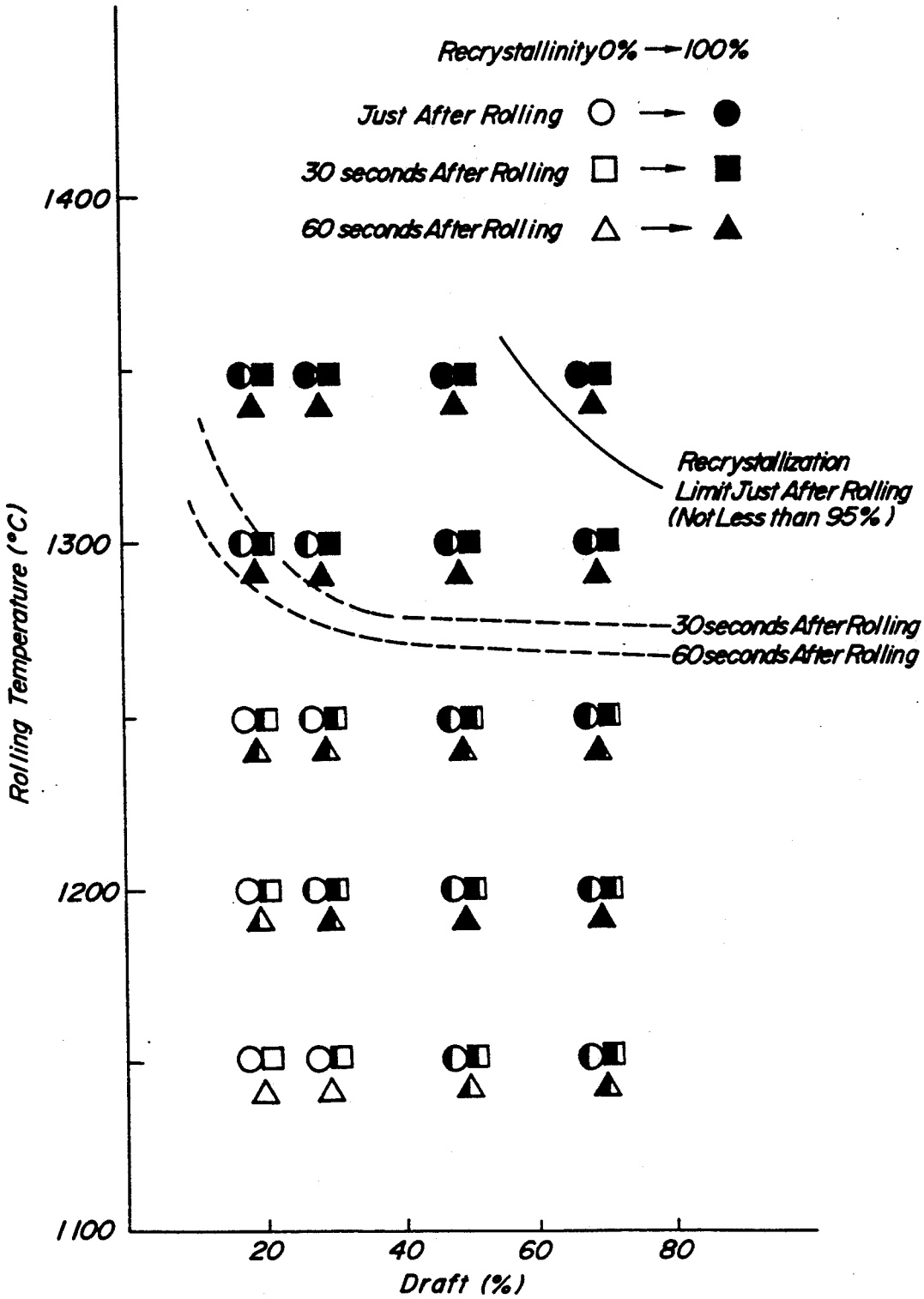
FIG. 3 is a graph showing a recystallization limit (recrystallinity of not less than 95%) at single $\alpha$-phase region by a relation between rolling temperature and draft.

The measured results are shown in FIG. 3 as a relation between rolling temperature and draft.

As seen from this figure, it has been confirmed that the recrystallization proceeds if the draft is not less than 30% even at a high temperature region, for example, 1350° C. which has been considered to generate no recrystallization in the conventional knowledge. And also, it has been found that the complete region of recrystallization is further enlarged by holding the temperature for not less than 30 seconds, preferably not less than 60 seconds after the rolling.

Such a phenomenon is understood as follows.

At first, it has been observed that subgrains constituted by rough network-like dislocation structure are formed in unrecrystallized grains after the rolling. Therefore, it is guessed that the restoring terminates at a fairly fast time after the rolling. Furthermore, it is considered that the roughness of the network or dislocation density is different in the crystal grains so that such a difference of dislocation density is a driving force of recrystallization. Since the grain boundary may be moved by thermal activation at the high temperature, if the moved grain has a curvature of not less than a certain value, it may be a nucleus for recrystallization.

As a result of the above phenomenon, it has been clarified that the recrystallization is actually possible even at the high temperature region which has hitherto been considered to store not enough strain to cause the dynamic recrystallization. Moreover, in this recrystallization behavior, the dislocation density of the unrecrystallized region is low as mentioned above, so that the driving force for the growth of the above region is very small. However, when the mobility of the grain boundary is very large or when the temperature is high (not lower than 1280° C.), the recrystallization is sufficiently possible though the time is required to a certain extent.

This phenomenon is considerably different from the conventionally well-known static recrystallization in the aspect.

Figure 4:
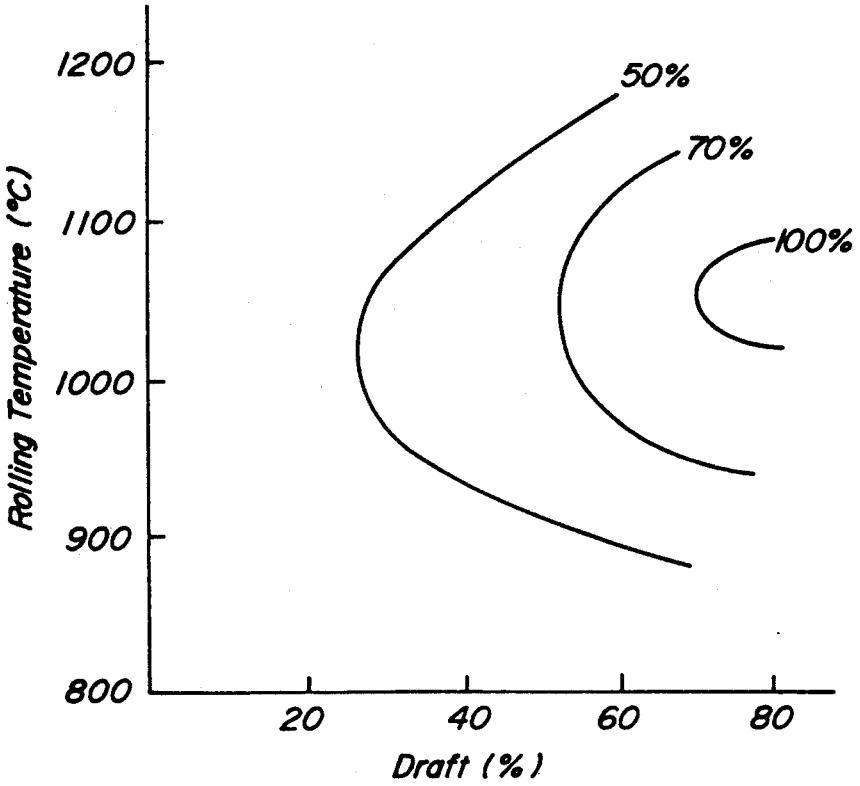
FIG. 4 is a graph showing a recrystallization limit at a $(\alpha+\beta)$ dual phase region.

The aforementioned fact is a case of rolling 3% silicon steel at a temperature region above 1300° C. or a recrystallization mechanism at a single $\alpha$-phase state, which is first revealed at this time. On the contrary, the recrystallization limit curve conventionally well-known in 3% silicon steel as shown in FIG. 4 is a case that hard $\gamma$-phase precipitates and the recrystallization is proceeded only in the vicinity thereof. That is, the data are obtained by the rolling experiment in the conventional technique, but the heat treating method prior to the rolling is also omitted, so that it is considered that the results are different from the experimental results making the basis of the invention. This is considered due to the fact that the sample solid-soluted at a high temperature was once cooled to room temperature and reheated to the given rolling temperature for the rolling. In this case, $\gamma$-phase is always and partly produced in the structure. This $\gamma$-phase is preferentially produced near to the boundary of $\alpha$-grains, at where the recrystallization is easily proceeded. Even in this case, however, when the original grain size is large as in the grains of the cast slab, the recrystallization hardly completes, and the unrecrystallized portion is always apt to be left in the central portion of the original grain. Furthermore, the percentage and dispersion of $\gamma$-phase are largely dependent upon not only the temperature but also C, Si amounts as well as strain quantity and cooling rate (holding time). Therefore, it is known that the effect largely changes even in a slight change of the treating condition. This is guessed to be a large reason why the effect of finely dividing grains by low temperature hot rolling is not stably obtained in the conventional technique. On the other hand, there is a drawback that the increase of C amount (increase of coarse carbide) hardly provides the rolling structure having a high alignment at post step.

On the contrary, the recrystallization behavior in single $\alpha$-phase region at high temperature found by the inventors is different from the conventional recrystallization at low temperature in the presence of $\gamma$-phase, in which the forming site of recrystallization nucleus is not $\gamma$-phase but is merely the grain boundary. Furthermore, the size of the recrystallized grain is apt to become relatively large, so that the unrecrystallized portion hardly remains and the uniform recrystallized grain structure is easily obtained.

Under the aforementioned recrystallization conditions at high temperature, coarse grains can finely be divided even when the slab heated at high temperature is rolled as it is. Furthermore, it is not required to render the temperature into low temperature during the waiting for the rolling in the course of the heating, so that the merit of the hot strip mill can be utilized at maximum.

The third embodiment of the invention is accomplished based on the above fundamental knowledges.

The construction of the third embodiment will be described in detail.

According to this invention, a slab of silicon steel having a chemical composition as mentioned later is placed in a heating furnace and then heated. Moreover, the heating temperature and heating time somewhat differ in accordance with the kind and amount of the inhibitor, but it is sufficient to ensure a time capable of achieving the complete solid solution of the inhibitor. However, if the time existing in the furnace is too long, a great amount of scale is created, so that the heating time is rendered into an extent not to badly affect the surface properties. Thus, the slab heated at the high temperature to render the inhibitor into a complete solid solution state is subjected to a rough rolling.

The rough rolling is usually carried out at 5–6 passes. According to the experimental results, it has been found that the first pass as well as the subsequent holding and the final pass are particularly important. In the holding after the first pass or just before the second pass, it is important to obtain a substantially complete recrystallized structure (recrystallinity: not less than 95%).

Figure 5:
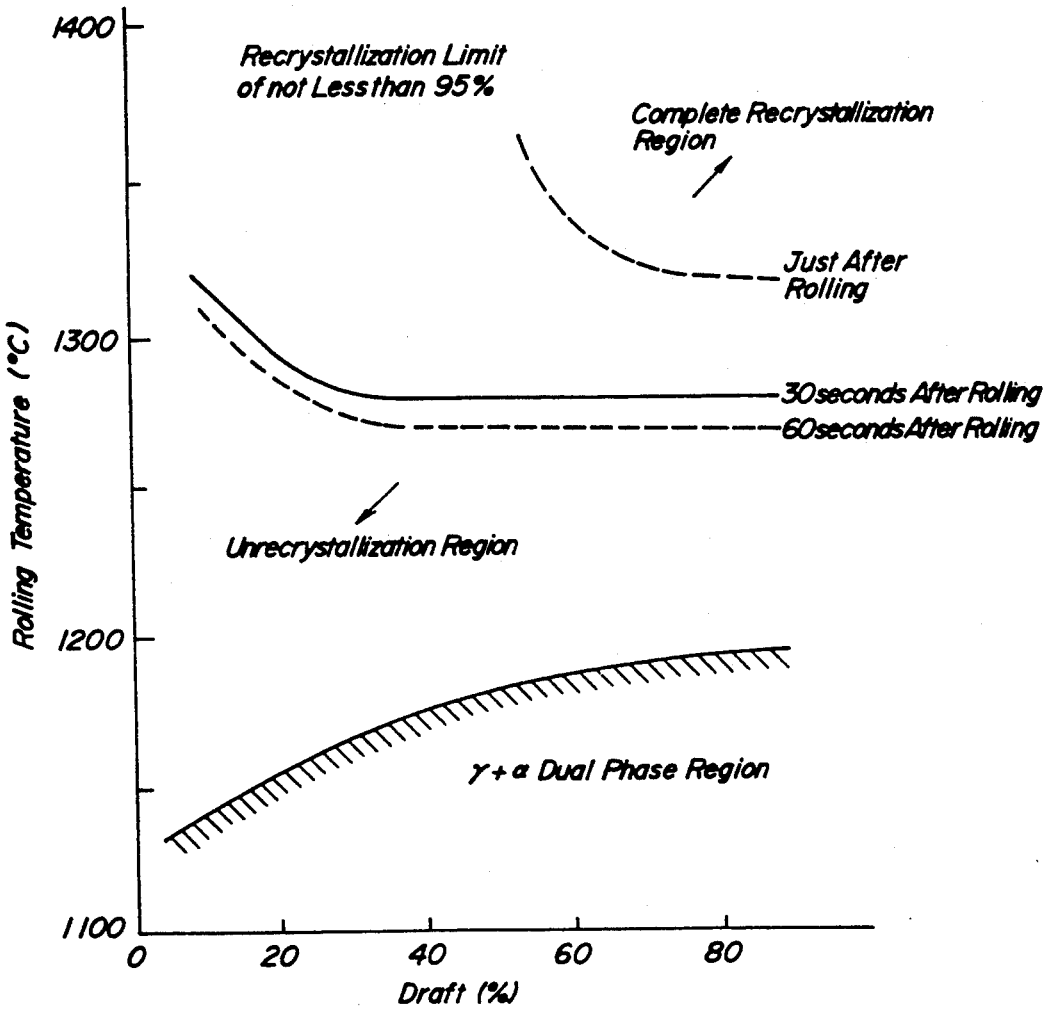
FIG. 5 is a graph showing a recrystallization limit at a single $\alpha$-phase region after a first pass of the hot rough rolling.

In FIG. 5 is shown a relation between the rolling temperature and the draft exerting onto the recrystallization actually made in a factory.

In the usual rolling method, the time between the passes is determined by the interval between stands of the rolling mill, in which the pass time between first and second rough stands is about 20 seconds. Therefore, it is very difficult to obtain a recrystallinity of not less than 95% just after the rolling. As seen from FIG. 5, the recrystallinity of not less than 95% can easily be obtained by holding the sheet for not less than 30 seconds, preferably not less than 60 seconds after the rolling.

Figure 6:
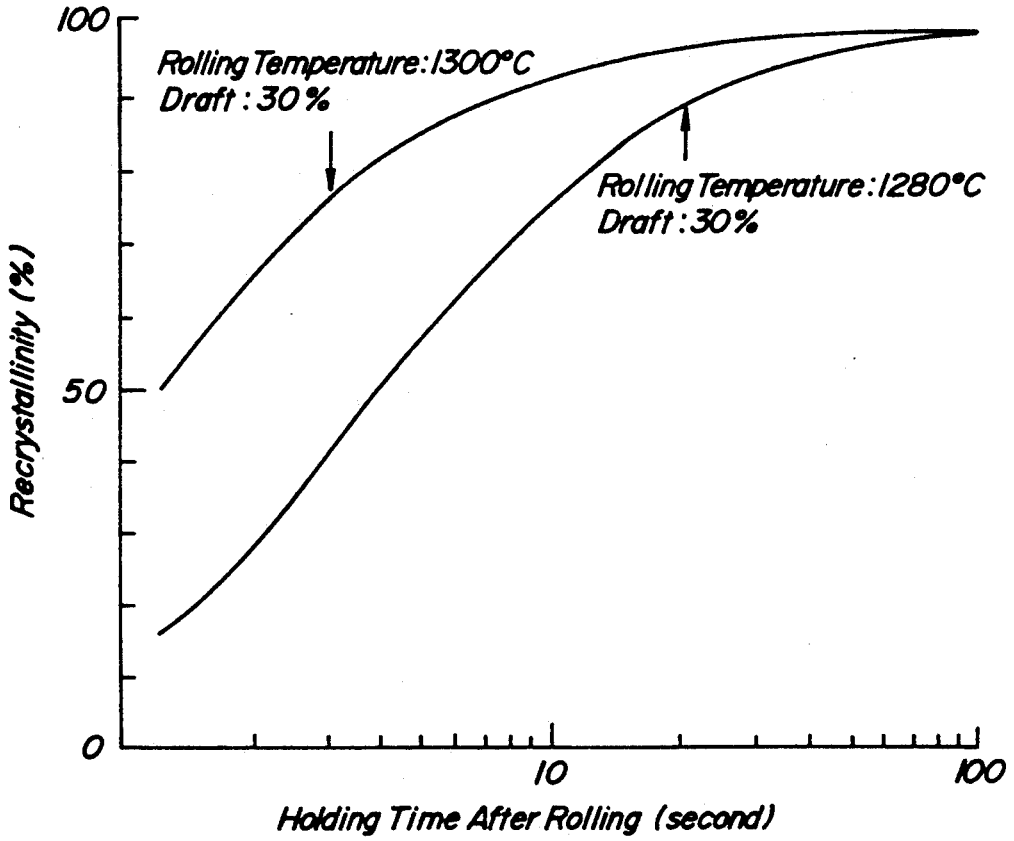
FIG. 6 is a graph showing a relation between holding time and recrystallinity after the rolling.

In FIG. 6 is shown results measured on the proceeding state of recrystallization when a first rolling pass is carried out at rolling temperatures of 1280° C. and 1300° C. under a draft of 30%, as a relation between the holding time after the rolling and the recrystallinity.

As seen from FIG. 6, the higher the rolling temperature, the better the recrystallization proceeding state, and when the rolling temperature is 1300° C., the recrystallinity of 95% is attained for about 10 seconds. In this point, when the rolling temperature is as low as 1280° C., about 30 seconds is required for obtaining recrystallinity: 95%.

According to the invention, therefore, the rolling temperature in the first pass of the rolling is determined to be not lower than 1280° C.

When the relation between rolling temperature $T_1$ °C.) and draft $R_1$ (%) in the first pass capable of attaining the target recrystallinity of 95% is calculated from the results of FIGS. 5 and 6, the following equation is obtained:

$$60 \geqq R_1(\%) \geqq -0.5T_1 + 670$$

In order to ensure the desired recrystallinity, it is required to hold the sheet for not less than 30 seconds, preferably not less than 60 seconds after the rolling.

And also, it has been found that the occurrence of spills resulting from hot tears at the surface portion is fairly suppressed if the recrystallization is completely attained at the first pass. Furthermore, it has been found that the above condition effectively controls the occurrence of the poor secondary recrystallized region through final annealing due to the presence of the unrecrystallized portion.

In the rough rolling, it is important that the unrecrystallized portion is not left in addition to the formation of fine recrystallization structure. For this end, it is required to conduct the recrystallization at the single $\alpha$-phase region even in the final pass of the rough rolling. Because, $\gamma$-grains are harder in $(\alpha+\gamma)$ dual phase region, so that strain concentrates and is stored in the vicinity of $\gamma$-grains and such $\gamma$-grains are preferentially recrystallized, but $\gamma$-grains mainly appear in old $\alpha$-grains, and consequently the structure always becomes nonuniform.

Figure 7:
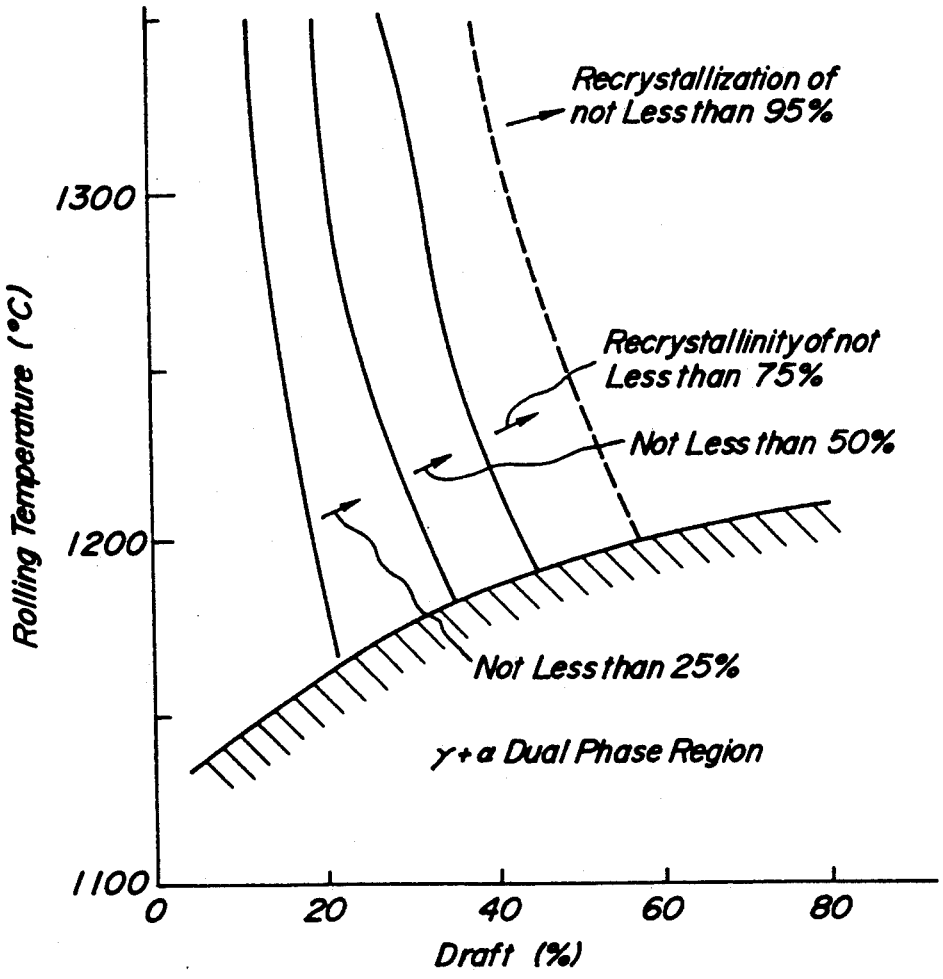
FIG. 7 is a graph showing a recrystallization limit at a single $\alpha$-phase region after plural passes of the hot rough rolling.

Since the crystal grains are finely recrystallized by the rolling effect just before the final pass of the rough rolling, the recrystallization limit shifts slightly downward from the experimental result in the factory previously shown in FIG. 5 as shown in FIG. 7. Moreover, a region appearing $\gamma$-phase is shown in FIG. 7 by oblique lines, in which the temperature appearing $\gamma$-phase becomes high as the draft increases. This is due to strain-induced transformation.

In the final pass, the rolling temperature $T_2$ (°C.) of at least 1200° C. is required for conducting the rolling at the single $\alpha$-phase region not appearing $\gamma$-phase. Furthermore, when a relation between the rolling temperature $T_2$ and draft $R_2$ (%) required for stably obtaining such a recrystallinity of not less than 75% that the remaining unrecrystallized portion after the final pass does not affect the degradation of secondary recrystallization at the final annealing is calculated from the results of FIGS. 7 and 4, the following equation was obtained:

$$70 \geqq R_2(\%) \geqq -0.1T_2+165$$

Moreover, the upper limit of the draft in the rough rolling is necessary to be set so as to ensure the sufficient draft even on the next pass and after. From this viewpoint, the upper limits of the drafts in the first pass and the final pass are limited to 60% and 70%, respectively.

The subsequent hot finish rolling may be conducted under conditions according to the usual manner, but the more excellent effect is obtained by combining the aforementioned first invention with the second invention.

Moreover, anyone of the conventionally well-known methods are applicable to subsequent cold rolling, decarburization annealing, and final finish annealing.

A preferable chemical composition of silicon-containing steel slab as a starting material according to the invention will be described below.

C: 0.01–0.10%

C is an element useful for not only the formation of fine and uniform structure in the hot rolling and the cold rolling but also the development of Goss orientation. It is preferable to add carbon in an amount of at least 0.01%. However, when the amount exceeds 0.10%, the disorder is caused in the Goss orientation, so that the upper limit is preferably about 0.10%.

Si: 2.0–4.5%

Si effectively contributes to enhance the specific resistance of the steel sheet and reduce the iron loss thereof. When the amount exceeds 4.5%, the cold ductility is damaged, while when it is less than 2.0%, not only the specific resistance decreases, but also the randomization of crystal orientation is caused due to $\alpha$-$\gamma$ transformation during the final high-temperature annealing required for secondary recrystallization purification and the sufficiently iron loss-improving effect is not obtained. Therefore, the Si amount is preferably about 2.0–4.5%.

Mn: 0.02–0.12%

Mn is required in an amount of at least about 0.02% for preventing the hot tear, but when the amount is too large, the magnetic properties are degraded, so that the upper limit is preferable to be defined to about 0.12%.

As the inhibitor, there are so-called MnS system, MnSe system and AlN system.

. Case of MnS, MnSe Systems

At least one one of Se and S: 0.005–0.06%

Each of Se, S is an element useful as an inhibitor controlling the secondary recrystallization of the grain oriented silicon steel sheet. From a viewpoint of ensuring the controlling force, an amount of at least about 0.005% is required, but when it exceeds 0.06%, the effect is damaged, so that the lower limit and upper limit are preferably about 0.01 and 0.06%, respectively.

. Case of AlN System

Al: 0 005–0.10%, N: 0.004–0.015%

The ranges of Al and N are defined to the above ranges from the same reason as in the aforementioned cases of MnS, MnSe systems. Moreover, the above MnS, MnSe and AlN systems may be used together.

As the inhibitor component, Cu, Sn, Cr, Ge, Sb, Mo, Te, Bi and P are advantageously adaptable in addition to the above S, Se, Al, so that they may be included in small amounts together. The preferable addition ranges of the above components are Cu, Sn, Cr: 0.01–0.15%, Ge, Sb, Mo, Te, Bi: 0.005–0.1%, P: 0.01–0.2%, and these inhibitor components may be used alone or in admixture.

Moreover, the slab aiming to the invention is a continuously cast slab or a slab obtained by blooming from an ingot, but naturally includes a slab obtained by blooming and rerolling.

EXAMPLE 1

(A) Continuously cast slab comprising C: 0.040%, Si: 3.30%, Mn: 0.054%, Se: 0.022%, Sb: 0.024% and the remainder being substantially Fe.

(B) Continuously cast slab comprising C: 0.35%, Si: 2.98%, Mn: 0.072%, Se: 0.024%, Al: 0.023%, N: 0.008% and the remainder being substantially Fe.

Each of the above slabs (A) and (B) was placed in a heating furnace, soaked in $N_2$ atmosphere and subjected to rough rolling immediately after the soaking. The rough rolling was carried out through 5–6 passes in accordance with the slab thickness under such a condition that the draft at each pass was approximately equal, whereby a sheet bar of 30 mm in thickness was obtained. Then, the sheet bar was hot rolled in a tandem mill to obtain a hot rolled steel sheet of 2.0 mm in thickness. The temperature after the final pass of the rough rolling and conditions in first pass of the finish rolling are shown in Table 1.

The hot rolled steel sheet was pickled, subjected to first cold rolling and intermediate annealing and further to second cold rolling to obtain a cold rolled steel sheet having a final thickness of 0.23 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 1.

Figure 8:
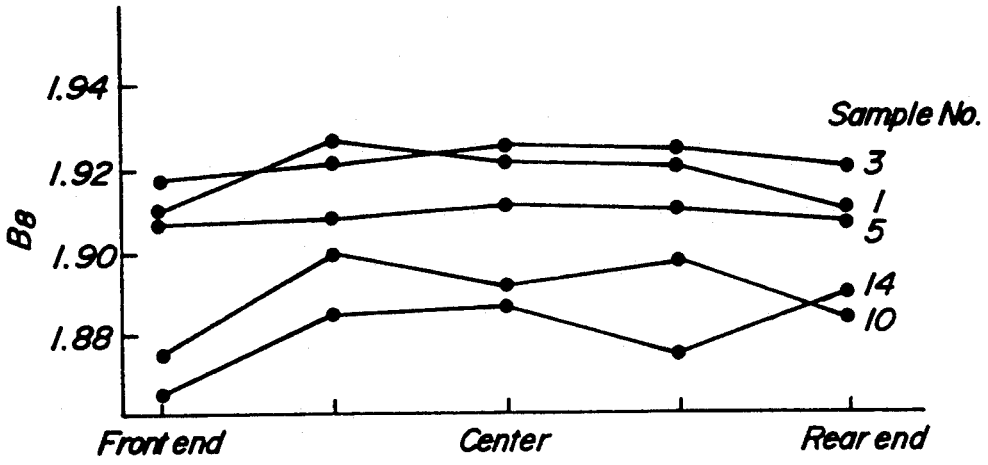
FIG. 8 is a graph showing changes of magnetic flux density in the longitudinal direction of a steel sheet as a comparison between invention examples and comparative examples.
Figure 9:
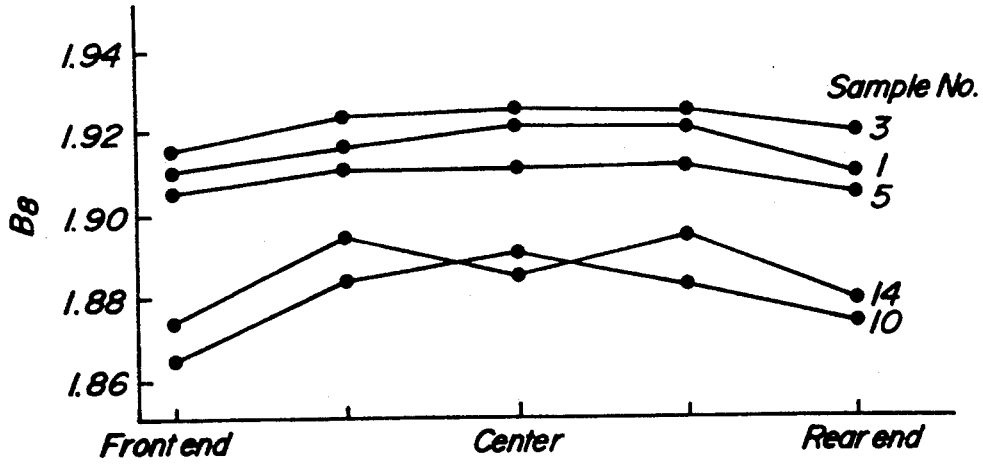
FIG. 9 is a graph showing changes of magnetic flux density in the widthwise direction of a steel sheet as a comparison between invention examples and comparative examples.

Furthermore, the scattering of the magnetic properties in longitudinal direction and widthwise direction was measured to obtain results as shown in FIGS. 8 and 9.

TABLE 1(a)

| No. | Slab composition | Temperature after final pass of rough rolling (°C.) | First pass of finish rolling temperature (°C.) | First pass of finish rolling draft (%) | Holding time at 1000–850° C. when rolling under conditions according to the invention | Magnetic properties $B_8$ (T) | Magnetic properties $W_{17/50}$ (w/kg) | Remarks |
|---|---|---|---|---|---|---|---|---|
| 1 | A | 1225 | 948 | 57 | 4 | 1.922 | 0.823 | acceptable example |
| 2 | A | 1251 | 935 | 52 | 7 | 1.921 | 0.829 | acceptable example |

TABLE 1(a)-continued

| No. | Slab composition | Temperature after final pass of rough rolling (°C.) | First pass of finish rolling temperature (°C.) | First pass of finish rolling draft (%) | Holding time at 1000–850° C. when rolling under conditions according to the invention | Magnetic properties $B_8$ (T) | Magnetic properties $W_{17/50}$ (w/kg) | Remarks |
|---|---|---|---|---|---|---|---|---|
| 3 | A | 1208 | 967 | 44 | 4 | 1.925 | 0.825 | acceptable example |
| 4 | A | 1238 | 913 | 56 | 7 | 1.924 | 0.824 | acceptable example |
| 5 | A | 1202 | 943 | 64 | 5 | 1.911 | 0.834 | acceptable example |
| 6 | B | 1247 | 903 | 45 | 4 | 1.920 | 0.830 | acceptable example |
| 7 | B | 1173 | 889 | 43 | 3 | 1.918 | 0.831 | acceptable example |
| 8 | B | 1214 | 923 | 51 | 5 | 1.932 | 0.822 | acceptable example |
| 9 | B | 1178 | 932 | 48 | 6 | 1.925 | 0.827 | acceptable example |
| 10 | A | 1145* | 903 | 57 | 3 | 1.891 | 0.867 | comparative example |
| 11 | A | 1139* | 910 | 48 | 5 | 1.880 | 0.891 | comparative example |
| 12 | B | 1120* | 861 | 49 | 4 | 1.883 | 0.903 | comparative example |

TABLE 1(b)

| No. | Slab composition | Temperature after final pass of rough rolling (°C.) | First pass of finish rolling temperature (°C.) | First pass of finish rolling draft (%) | Holding time at 1000–850° C. when rolling under conditions according to the invention | Magnetic properties $B_8$ (T) | Magnetic properties $W_{17/50}$ (w/kg) | Remarks |
|---|---|---|---|---|---|---|---|---|
| 13 | A | 1217 | 908 | 35* | 5 | 1.892 | 0.892 | comparative example |
| 14 | A | 1178 | 895 | 30* | 5 | 1.887 | 0.903 | comparative example |
| 15 | B | 1221 | 881 | 33* | 3 | 1.882 | 0.901 | comparative example |
| 16 | A | 1164 | 841* | 41 | — | 1.860 | 0.912 | comparative example |
| 17 | B | 1162 | 832* | 50 | — | 1.872 | 0.917 | comparative example |
| 18 | A | 1218 | 946 | 45 | 21* | 1.860 | 0.903 | comparative example |
| 19 | B | 1160 | 863 | 42 | 1.5* | 1.887 | 0.891 | comparative example |
| 20 | A | 1145* | 845* | 38* | — | 1.878 | 0.918 | comparative example |
| 21 | A | 1166 | 856 | 38* | 1.5* | 1.873 | 0.906 | comparative example |
| 22 | A | 1205 | 972 | 45 | 3 | 1.910 | 0.823 | acceptable example |
| 23 | B | 1231 | 968 | 63 | 4 | 1.915 | 0.824 | acceptable example |
| 24 | A | 1232 | 995 | 43 | 21* | 1.871 | 0.909 | comparative example |

*outside scope of the invention

As seen from Table 1 and FIGS. 8 and 9, when the first pass in the finish rolling is carried out at a temperature of 1000°–850° C. and a draft of not less than 40% and this temperature is held for 2–20 seconds, not only the magnetic properties are excellent, but also the uniformity of the magnetic properties in the widthwise direction and longitudinal direction is excellent.

EXAMPLE 2

(C) Continuously cast slab comprising C: 0.040%, Si: 3.14%, Mn: 0.054%, Se: 0.023%, Sb: 0.024%, Mo: 0.020% and the remainder being substantially Fe.

(D) Continuously cast slab comprising C: 0.039%, Si: 3.30%, Mn: 0.054%, Se: 0.019%, Sn: 0.082% and the remainder being substantially Fe.

(E) Continuously cast slab comprising C: 0.040%, Si: 3.30%, Mn: 0.054%, Se: 0.022%, Sb: 0.024%, As: 0.020% and the remainder being substantially Fe.

(F) Continuously cast slab comprising C: 0.040%, Si: 3.30%, Mn: 0.054%, Se: 0.022%, Sb: 0.024%, Cu: 0.04% and the remainder being substantially Fe.

(G) Continuously cast slab comprising C: 0.040%, Si: 3.30%, Mn: 0.054%, Se: 0.022%, Sb: 0.024%, Bi: 0.02% and the remainder being substantially Fe.

(H) Continuously cast slab comprising C: 0.040%, Si: 3.30%, Mn: 0.054%, Se: 0.022% and the remainder being substantially Fe.

(I) Continuously cast slab comprising C: 0.036%, Si: 3.01%, Mn: 0.069%, Se: 0.023%, Sb: 0.020%, Al: 0.021%, N: 0.008% and the remainder being substantially Fe.

Each of the above slabs was placed in a heating furnace, soaked in an $N_2$ atmosphere, and then subjected to a rough rolling just after the soaking. The rough rolling was carried out through 5–6 passes in accordance with the slab thickness under such a condition that the draft at each pass was approximately equal, whereby a sheet bar of 30 mm in thickness was obtained. Then, the sheet bar was hot rolled in a tandem mill to obtain a hot rolled steel sheet of 2.0 mm in thickness. The temperature after the final pass of the rough rolling and conditions in first pass of the finish rolling are shown in Table 2.

The hot rolled steel sheet was pickled, subjected to first cold rolling and intermediate annealing and further to second cold rolling to obtain a cold rolled steel sheet having a final thickness of 0.23 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 2. In any slab compositions, the products obtained according to the invention are excellent as compared with the comparative examples.

TABLE 2

| No. | Slab composition | Temperature after final pass of rough rolling (°C.) | First pass of finish rolling temperature (°C.) | First pass of finish rolling draft (%) | Holding time at 1000–850° C. when rolling under conditions according to the invention | Magnetic properties $B_8$ (T) | Magnetic properties $W_{17/50}$ (w/kg) | Remarks |
|---|---|---|---|---|---|---|---|---|
| 25 | C | 1235 | 948 | 54 | 4 | 1.921 | 0.832 | acceptable example |
| 26 | C | 1251 | 835* | 52 | 1.4* | 1.891 | 0.899 | comparative example |
| 27 | D | 1208 | 867 | 46 | 4 | 1.924 | 0.823 | acceptable example |
| 28 | D | 1113* | 903 | 53 | 6 | 1.884 | 0.901 | comparative example |
| 29 | E | 1202 | 943 | 63 | 5 | 1.913 | 0.835 | acceptable example |
| 30 | E | 1247 | 903 | 38* | 4 | 1.899 | 0.911 | comparative example |
| 31 | F | 1173 | 889 | 45 | 3 | 1.917 | 0.832 | acceptable example |
| 32 | F | 1250 | 923 | 43 | 21* | 1.882 | 0.921 | comparative example |
| 33 | G | 1178 | 932 | 48 | 6 | 1.924 | 0.826 | acceptable example |
| 34 | G | 1145* | 903 | 57 | 3 | 1.901 | 0.877 | comparative example |
| 35 | H | 1253 | 940 | 55 | 3 | 1.922 | 0.830 | acceptable example |
| 36 | H | 1246 | 910 | 35* | 5 | 1.882 | 0.920 | comparative example |
| 37 | I | 1252 | 938 | 60 | 4 | 1.923 | 0.832 | acceptable example |
| 38 | I | 1220 | 840* | 57 | 3 | 1.901 | 0.930 | comparative example |

*outside scope of the invention

EXAMPLE 3

(J) Continuously cast slab comprising C: 0.040%, Si: 3.14%, Mn: 0.054%, Se: 0.023%, Sb: 0.024%, Al: 0.022%, N: 0.008%, Mo: 0.020% and the remainder being substantially Fe.

(K) Continuously cast slab comprising C: 0.039%, Si: 3.30%, Mn: 0.054%, Se: 0.019%, Sb: 0.022%, Al: 0.023%, N: 0.008%, Sn: 0.080% and the remainder being substantially Fe.

(L) Continuously cast slab comprising C: 0.039%, Si: 3.29%, Mn: 0.053%, Se: 0.020%, Sb: 0.023%, Al: 0.020%, N: 0.009%, As: 0.020% and the remainder being substantially Fe.

(M) Continuously cast slab comprising C: 0.040%, Si: 3.29%, Mn: 0.054%, Se: 0.021%, Sb: 0.024%, Al: 0.022%, N: 0.008%, Cu: 0.04% and the remainder being substantially Fe.

(N) Continuously cast slab comprising C: 0.038%, Si: 3.31%, Mn: 0.054%, Se: 0.022%, Sb: 0.024%, Al: 0.024%, N: 0.008%, Bi: 0.02% and the remainder being substantially Fe.

Each of the above slabs was placed in a heating furnace, soaked in an $N_2$ atmosphere, and then subjected to a rough rolling just after the soaking. The rough rolling was carried out through 5–6 passes in accordance with the slab thickness under such a condition that the draft at each pass was approximately equal, whereby a sheet bar of 30 mm in thickness was obtained. Then, the sheet bar was hot rolled in a tandem mill to obtain a hot rolled steel sheet of 2.0 mm in thickness. The temperature after the final pass of the rough rolling and conditions in first pass of the finish rolling are shown in Table 3.

The hot rolled steel sheet was pickled, subjected to first cold rolling and intermediate annealing and further to second cold rolling to obtain a cold rolled steel sheet having a final thickness of 0.23 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 3. In any slab compositions, the products obtained according to the invention are excellent as compared with the comparative examples.

TABLE 3

| No. | Slab composition | Temperature after final pass of rough rolling (°C.) | First pass of finish rolling temperature (°C.) | First pass of finish rolling draft (%) | Holding time at 1000–850° C. when rolling under conditions according to the invention | Magnetic properties $B_8$ (T) | Magnetic properties $W_{17/50}$ (w/kg) | Remarks |
|---|---|---|---|---|---|---|---|---|
| 39 | J | 1245 | 947 | 54 | 4 | 1.924 | 0.822 | acceptable example |
| 40 | J | 1241 | 834* | 50 | 1.6* | 1.891 | 0.903 | comparative example |
| 41 | K | 1232 | 891 | 50 | 4 | 1.921 | 0.820 | acceptable example |
| 42 | K | 1115* | 920 | 48 | 4 | 1.880 | 0.899 | comparative example |
| 43 | L | 1230 | 949 | 53 | 5 | 1.919 | 0.822 | acceptable example |
| 44 | L | 1245 | 910 | 35* | 4 | 1.890 | 0.901 | comparative example |
| 45 | M | 1210 | 912 | 51 | 3 | 1.918 | 0.830 | acceptable example |
| 46 | M | 1242 | 948 | 43 | 21* | 1.883 | 0.926 | comparative example |
| 47 | N | 1192 | 939 | 52 | 5 | 1.922 | 0.825 | acceptable example |
| 48 | N | 1145* | 903 | 57 | 3 | 1.899 | 0.897 | comparative example |

*outside scope of the invention

EXAMPLE 4

(O) Continuously cast slab comprising C: 0.041%, Si: 3.10%, Mn: 0.074%, Se: 0.021% and the remainder being substantially Fe.

(P) Continuously cast slab comprising C: 0.040%, Si: 3.29%, Mn: 0.064%, Se: 0.020%, Sb: 0.024% and the remainder being substantially Fe.

(Q) Continuously cast slab comprising C: 0.035%, Si: 3.00%, Mn: 0.072%, Se: 0.023%, Al: 0.023%, N: 0.008% and the remainder being substantially Fe.

Each of the above slabs was immediately placed in a gas heating furnace, soaked in an $N_2$ atmosphere, further placed into an induction heating furnace, at where a temperature difference between temperature of central portion being 1430° C. and temperature of surface portion being 1370° C. was sufficiently ensured, and immediately subjected to a rough rolling. The rough rolling was carried out through 5–6 passes in accordance with the slab thickness under such a condition that the draft at each pass was approximately equal, whereby a sheet bar of 40 mm in thickness was obtained. Moreover, the surface was positively cooled during the rough rolling. Then, the sheet bar was hot rolled in a tandem mill to obtain a hot rolled steel sheet of 3.0 mm in thickness. In this case, the surface of the sheet bar was sufficiently cooled with a high pressure water prior to the finish rolling. The conditions of the finish rolling are shown in Table 4.

The hot rolled steel sheet was pickled, subjected to first cold rolling and intermediate annealing and further to second cold rolling to obtain a cold rolled steel sheet having a final thickness of 0.23 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 4.

TABLE 4(a)

| No. | Slab composition | Use method of heating furnace | First pass of finish rolling draft (%) | First pass of finish rolling temperature of central portion (°C.) | First pass of finish rolling in 1/20 layer temperature (°C.) | First pass of finish rolling in 1/20 layer holding time (s) | At central temperature of 950–850° C. draft (%) | At central temperature of 950–850° C. holding time (s) | Magnetic properties $B_8$ (T) | Magnetic properties $W_{17/50}$ (W/kg) | Remarks |
|---|---|---|---|---|---|---|---|---|---|---|---|
| 49 | O | ○ | 42 | 1151 | 970 | 4 | 45 | 3 | 1.922 | 0.970 | acceptable example |
| 50 | O | Δ | 50 | 1153 | 995 | 5 | 43 | 4 | 1.925 | 0.968 | acceptable example |
| 51 | O | ○ | 43 | 1155 | 990 | 7 | 56 | 3 | 1.912 | 0.972 | acceptable example |
| 52 | O | Δ | 46 | 1160 | 996 | 6 | 60 | 5 | 1.911 | 0.971 | acceptable example |
| 53 | O | ○ | 47 | 1154 | 965 | 5 | 51 | 6 | 1.919 | 0.978 | acceptable example |
| 54 | O | ○ | 48 | 1110* | 960 | 3 | 45 | 7 | 1.890 | 1.051 | comparative example |
| 55 | O | Δ | 38* | 1153 | 970 | 4 | 35* | 2 | 1.900 | 1.020 | comparative example |
| 56 | O | ○ | 45 | 1163 | 981 | 4 | 42 | 1* | 1.883 | 1.031 | comparative example |
| 57 | O | ○ | 43 | 1160 | 1030* | — | 54 | 4 | 1.882 | 1.003 | comparative example |
| 58 | O | X | 48 | 1145* | 1050* | — | 53 | 5 | 1.872 | 1.041 | comparative example |

TABLE 4(a)-continued

| No. | Slab composition | Use method of heating furnace | First pass of finish rolling: draft (%) | temperature of central portion (°C.) | in 1/20 layer: temperature (°C.) | holding time (s) | At central temperature of 950–850° C.: draft (%) | holding time (s) | Magnetic properties: $B_8$ (T) | $W_{17/50}$ (W/kg) | Remarks |
|---|---|---|---|---|---|---|---|---|---|---|---|
| 59 | P | ○ | 46 | 1160 | 973 | 5 | 48 | 5 | 1.930 | 0.969 | acceptable example |
| 60 | P | Δ | 52 | 1172 | 980 | 4 | 55 | 5 | 1.910 | 0.970 | acceptable example |
| 61 | P | ○ | 53 | 1159 | 990 | 3 | 65 | 4 | 1.913 | 0.980 | acceptable example |

TABLE 4(b)

| No. | Slab composition | Use method of heating furnace | First pass of finish rolling: draft (%) | temperature of central portion (°C.) | in 1/20 layer: temperature (°C.) | holding time (s) | At central temperature of 950–850° C.: draft (%) | holding time (s) | Magnetic properties: $B_8$ (T) | $W_{17/50}$ (W/kg) | Remarks |
|---|---|---|---|---|---|---|---|---|---|---|---|
| 62 | P | ○ | 45 | 1131* | 975 | 2 | 70 | 3 | 1.821 | 1.035 | comparative example |
| 63 | P | ○ | 48 | 1162 | 1060* | — | 63 | 2 | 1.830 | 1.050 | comparative example |
| 64 | P | ○ | 49 | 1160 | 953 | 1* | 54 | 3 | 1.822 | 1.052 | comparative example |
| 65 | P | Δ | 45 | 1163 | 965 | 5 | 30* | 3 | 1.873 | 1.041 | comparative example |
| 66 | P | ○ | 45 | 1168 | 983 | 3 | 66 | 1* | 1.881 | 1.054 | comparative example |
| 67 | P | X | 62 | 1105* | 998 | 5 | 55 | 3 | 1.889 | 1.053 | comparative example |
| 68 | Q | Δ | 51 | 1173 | 973 | 6 | 45 | 4 | 1.925 | 0.965 | acceptable example |
| 69 | Q | ○ | 49 | 1172 | 965 | 4 | 63 | 3 | 1.919 | 0.975 | acceptable example |
| 70 | Q | ○ | 53 | 1164 | 969 | 3 | 35* | 2 | 1.891 | 1.057 | comparative example |
| 71 | Q | ○ | 49 | 1153 | 976 | 1* | 56 | 3 | 1.870 | 1.063 | comparative example |
| 72 | Q | X | 52 | 1020* | 945* | — | 71 | 5 | 1.873 | 1.055 | comparative example |
| 73 | Q | ○ | 53 | 1180 | 1006* | — | 54 | 3 | 1.885 | 1.049 | comparative example |
| 74 | Q | X | 35* | 1082 | 997 | 6 | 46 | 4 | 1.860 | 1.056 | comparative example |

Note 1: Use method of heating furnace
○: gas furnace + induction heating furnace
Δ: only induction heating furnace
X: only gas furnace
Note 2: outside scope of the invention As seen from Table 4, when the first pass of the finish rolling is carried out under conditions that the draft is not less than 40% at the temperature of the 1/20 layer of 1000° C.–950° C. and this temperature is held for 3–20 seconds and further the working strain at a draft of not less than 40% is applied at the temperature of the central portion of 950° C.–850° C. and this temperature is held for 2–20 seconds, the improved magnetic properties are stably obtained.

In Table 4 is also shown a case using no induction heating furnace. In this case, it is very difficult to take the temperature difference and the temperature difference between the surface layer and the central portion hardly ensures, so that the properties are not stably obtained.

EXAMPLE 5

A continuously cast slab comprising C: 0.043%, Si: 3.08%, Mn: 0.070%, Se: 0.022%, Sb: 0.020% and the remainder being substantially Fe was immediately placed in a gas heating furnace, soaked in an $N_2$ atmosphere to render the temperature of central portion into 1370° C. and the temperature of surface portion into 1410° C., and immediately subjected to a rough rolling. The rough rolling was carried out through 5–6 passes in accordance with the slab thickness under such a condition that the draft at each pass was approximately equal, whereby a sheet bar of 30 mm in thickness was obtained. Then, the sheet bar was hot rolled in a tandem mill to obtain a hot rolled steel sheet of 2.0 mm in thickness. The conditions of the finish rolling are shown in Table 5.

On the other hand, each continuously cast slab having the above composition was immediately placed in a gas heating furnace, soaked in an $N_2$ atmosphere, further placed into an induction heating furnace, where the temperature difference between the temperature of the central portion at 1430° C. and the temperature of the surface portion at 1370° C. was sufficiently ensured, and immediately subjected to a rough rolling. The rough rolling was carried out under the same conditions as described above, whereby a sheet bar of 40 mm in thickness was obtained. Moreover, the surface was positively cooled during the rough rolling. Then, the sheet bar was hot rolled in a tandem mill to obtain a hot rolled steel sheet of 2.0 mm in thickness. The conditions of the finish rolling are shown in Table 5.

The hot rolled steel sheet was pickled, subjected to first cold rolling and intermediate annealing and further to second cold rolling to obtain a cold rolled steel sheet having a final thickness of 0.23 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 5.

In Table 5 are also shown results measured on a case that the temperature of the decarburization annealing at the above steps is shifted to 20° C. higher than the optimum temperature.

From this table, it is understood that when the inhibitor in the hot rolled sheet is controlled at the direction of sheet thickness, the magnetic properties can stably be improved even in the change of treating conditions frequently generated in the actual running line.

EXAMPLE 6

A continuously cast slab comprising C: 0.040%, Si: 3.30%, Mn: 0.054%, Se: 0.022%, Sb: 0.024% and the remainder being substantially Fe was placed into a heating furnace, soaked in an $N_2$ atmosphere, and subjected to a rough rolling under conditions as shown in Table 6 immediately after the soaking, whereby a sheet bar of 30 mm in thickness was obtained.

Then, the sheet bar was hot rolled in a tandem mill to obtain a hot rolled steel sheet of 2.0 mm in thickness. The hot rolled steel sheet was pickled and subjected to first cold rolling—intermediate annealing —second cold rolling to obtain a cold rolled steel sheet having a final thickness of 0.23 mm. Thereafter, the sheet was subjected to decarburization annealing, coated with a slurry of an annealing separator consisting mainly of MgO, and subjected to a final finish annealing comprised of secondary recrystallization annealing and purification annealing to obtain a product.

The magnetic properties, surface properties and ratio of poor secondary recrystallized portion in the widthwise direction of the thus obtained product were measured to obtain results shown in Table 6.

Figure 10:
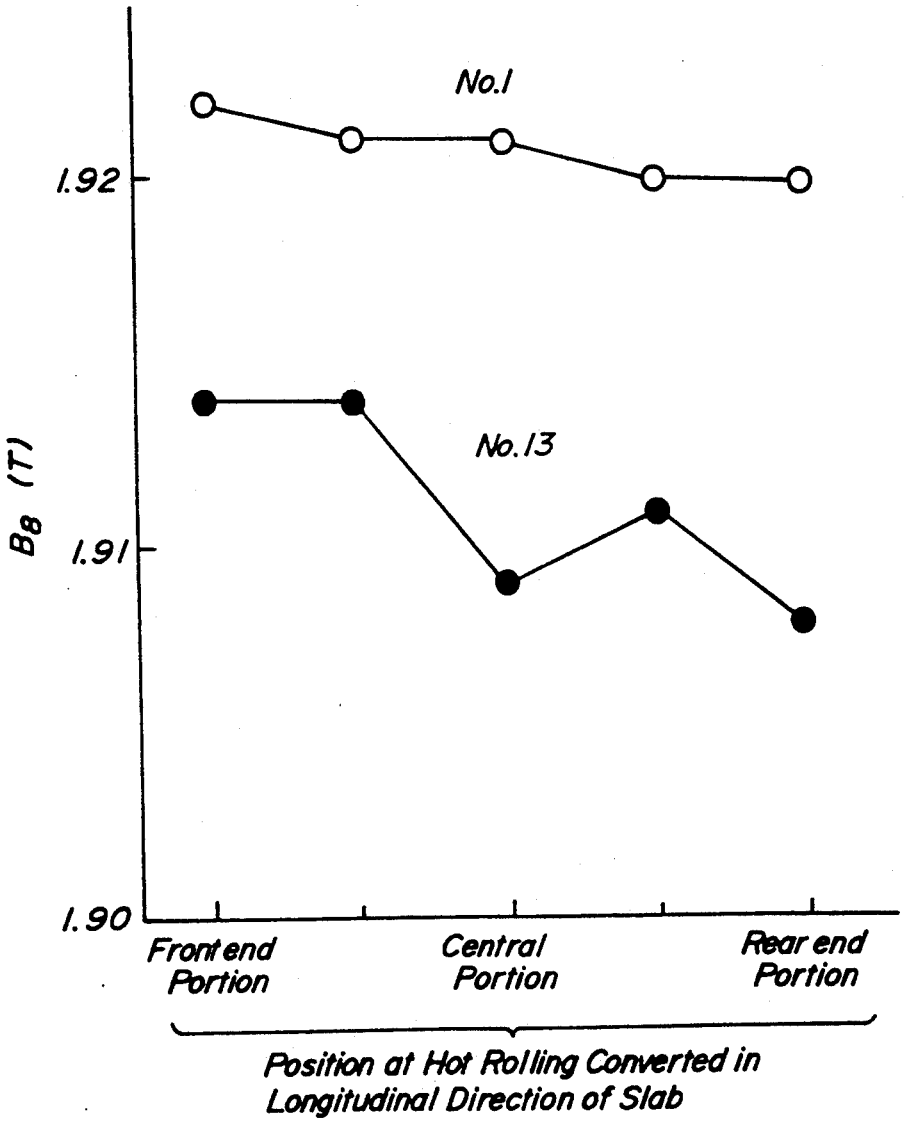
FIG. 10 is a graph showing a change of magnetic flux density in the longitudinal direction of a steel sheet as a comparison among invention examples and comparative examples.

Furthermore, results measured on the scattering of magnetic flux density in the longitudinal direction of the steel sheet are shown in FIG. 10.

TABLE 5

| | First pass of finish rolling | | | | At central temperature of 950–850° C. | | | | Ratio of achieving $B_8$ of not more than 190 T when decarburization annealing is carried out at a temperature higher by 20° C. |
|---|---|---|---|---|---|---|---|---|---|
| | | temperature of | in 1/20 layer | | | | Magnetic properties | | |
| No. | draft (%) | central portion (°C.) | temperature (°C.) | holding time (s) | draft (%) | holding time (s) | $B_8$ (T) | $W_{17/50}$ (W/kg) | |
| 1 | 55 | 1155 | 970 | 5 | 51 | 4 | 1.923 | 0.830 | 10 |
| 2 | 48 | 1151 | 995 | 4 | 49 | 3 | 1.925 | 0.835 | 8 |
| 3 | 57 | 1154 | 991 | 7 | 52 | 5 | 1.915 | 0.829 | 11 |
| 4 | 56 | 1000 | 996 | 6 | — | — | 1.911 | 0.839 | 50 |
| 5 | 51 | 995 | 965 | 5 | — | — | 1.909 | 0.826 | 65 |
| 6 | 48 | 989 | 960 | 3 | — | — | 1.915 | 0.839 | 48 |

TABLE 6(a)

| | Slab | First pass of rough rolling | | | Final pass of rough rolling | | Magnetic properties | | | Ratio of abnormal grains in widthwise | |
|---|---|---|---|---|---|---|---|---|---|---|---|
| No. | heating temperature (°C.) | temperature $T_1$ (°C.) | draft $R_1$ (%) | interval time between passes (s) | temperature $T_2$ (°C.) | draft $R_2$ (%) | $B_8$ (T) | $W_{17/50}$ (W/kg) | Ratio of spill generated (%) | direction (%) | Remarks |
| 1 | 1435 | 1363 | 59 | 43 | 1228 | 47 | 1.922 | 0.822 | 0.30 | 0.12 | acceptable example |
| 2 | 1433 | 1348 | 36 | 110 | 1215 | 53 | 1.923 | 0.833 | 0.24 | 0.21 | acceptable example |
| 3 | 1442 | 1330 | 31 | 71 | 1208 | 59 | 1.921 | 0.831 | 0.24 | 0.18 | acceptable example |
| 4 | 1421 | 1352 | 51 | 64 | 1248 | 59 | 1.924 | 0.830 | 0.27 | 0.17 | acceptable example |
| 5 | 1385 | 1311 | 56 | 36 | 1228 | 60 | 1.925 | 0.825 | 0.31 | 0.14 | acceptable example |
| 6 | 1423 | 1341 | 48 | 45 | 1249 | 45 | 1.920 | 0.837 | 0.22 | 0.20 | acceptable example |
| 7 | 1390 | 1328 | 39 | 59 | 1202 | 46 | 1.923 | 0.828 | 0.26 | 0.23 | acceptable example |
| 8 | 1410 | 1337 | 20 | 95 | 1245 | 67 | 1.927 | 0.815 | 0.24 | 0.19 | acceptable example |
| 9 | 1395 | 1305 | 24 | 75 | 1209 | 68 | 1.934 | 0.819 | 0.29 | 0.24 | acceptable example |

TABLE 6(b)

| No. | Slab heating temperature (°C.) | First pass of rough rolling: temperature $T_1$ (°C.) | draft $R_1$ (%) | interval time between passes (s) | Final pass of rough rolling: temperature $T_2$ (°C.) | draft $R_2$ (%) | Magnetic properties: $B_8$ (T) | $W_{17/50}$ (W/kg) | Ratio of spill generated (%) | Ratio of abnormal grains in widthwise direction (%) | Remarks |
|---|---|---|---|---|---|---|---|---|---|---|---|
| 10 | 1405 | 1302 | 42 | 55 | 1237 | 50 | 1.926 | 0.834 | 0.27 | 0.27 | acceptable example |
| 11 | 1375 | 1283 | 31 | 78 | 1266 | 53 | 1.931 | 0.827 | 0.31 | 0.25 | acceptable example |
| 12 | 1380 | 1281 | 58 | 50 | 1251 | 45 | 1.928 | 0.828 | 0.19 | 0.28 | acceptable example |
| 13 | 1440 | 1323 | 44 | 24* | 1210 | 47 | 1.904 | 0.851 | 0.45 | 3.24 | comparative example |
| 14 | 1370 | 1285 | 63* | 32 | 1140* | 55 | 1.903 | 0.897 | 1.67 | 2.24 | comparative example |
| 15 | 1365 | 1196* | 58* | 25* | 1134* | 28* | 1.897 | 0.906 | 1.77 | 2.77 | comparative example |
| 16 | 1388 | 1246* | 24* | 35 | 1267 | 40 | 1.886 | 0.943 | 3.27 | 3.15 | comparative example |
| 17 | 1366 | 1185* | 42* | 33 | 1084* | 30* | 1.891 | 0.913 | 2.24 | 4.26 | comparative example |
| 18 | 1408 | 1291 | 33 | 26* | 1208 | 50 | 1.892 | 0.905 | 2.68 | 3.42 | comparative example |

*outside scope of the invention

As seen from Table 6 and FIG. 10, when the rough rolling is carried out at a high temperature and a large draft according to the invention, the secondary recrystallization uniformly proceeds in the widthwise direction to provide improved magnetic properties, and also the surface properties are good and further the uniformity of the magnetic properties in the longitudinal direction is excellent.

EXAMPLE 7

A continuously cast slab comprising C: 0.035%, Si: 2.98%, Mn: 0.072%, S: 0.018% and the remainder being substantially Fe was placed into a heating furnace, soaked in an $N_2$ atmosphere, and subjected to a rough rolling under conditions as shown in Table 7 immediately after the soaking, whereby a sheet bar of 35 mm in thickness was obtained.

Then, the sheet bar was hot rolled in a tandem mill to obtain a hot rolled steel sheet of 2.4 mm in thickness. The hot rolled steel sheet was pickled and subjected to first cold rolling—intermediate annealing —second cold rolling to obtain a cold rolled steel sheet having a final thickness of 0.35 mm. Thereafter, the sheet was subjected to decarburization annealing, coated with a slurry of an annealing separator consisting mainly of MgO, and subjected to a final finish annealing comprised of secondary recrystallization annealing and purification annealing to obtain a product.

The magnetic properties, surface properties and ratio of poor secondary recrystallized portion in widthwise direction of the thus obtained product were measured to obtain results shown in Table 7.

TABLE 7

| No. | Slab heating temperature (°C.) | First pass of rough rolling: temperature $T_1$ (°C.) | draft $R_1$ (%) | interval time between passes (s) | Final pass of rough rolling: temperature $T_2$ (°C.) | draft $R_2$ (%) | Magnetic properties: $B_8$ (T) | $W_{17/50}$ (W/kg) | Ratio of spill generated (%) | Ratio of abnormal grains in widthwise direction (%) | Remarks |
|---|---|---|---|---|---|---|---|---|---|---|---|
| 1 | 1437 | 1343 | 52 | 31 | 1232 | 44 | 1.882 | 1.263 | 0.42 | 0.11 | acceptable example |
| 2 | 1381 | 1285 | 45 | 44 | 1208 | 55 | 1.879 | 1.271 | 0.38 | 0.22 | acceptable example |
| 3 | 1408 | 1283 | 40 | 14* | 1182* | 47 | 1.856 | 1.407 | 1.15 | 3.54 | comparative example |
| 4 | 1367 | 1242* | 53 | 63 | 1234 | 45 | 1.849 | 1.418 | 1.54 | 2.79 | comparative example |

*outside scope of the invention

As seen from Table 7, when the rough rolling is carried out at a high temperature and a large draft according to the invention, the secondary recrystallization uniformly proceeds in the widthwise direction to provide improved magnetic properties, and also the surface properties are good and further the uniformity of the magnetic properties in the longitudinal direction is excellent.

EXAMPLE 8

A continuously cast slab comprising C: 0.050%, Si: 3.10%, Mn: 0.078%, S: 0.024%, Al: 0.032%, N: 0.006% and the remainder being substantially Fe was placed into a heating furnace, soaked in an $N_2$ atmosphere, and subjected to a rough rolling under conditions as shown in Table 6 immediately after the soaking, whereby a sheet bar of 30 mm in thickness was obtained.

Then, the sheet bar was hot rolled in a tandem mill to obtain a hot rolled steel sheet of 2.3 mm in thickness. The hot rolled steel sheet was pickled and subjected to first cold rolling—intermediate annealing —second cold rolling to obtain a cold rolled steel sheet having a final thickness of 0.23 mm. Thereafter, the sheet was subjected to decarburization annealing, coated with a slurry of an annealing separator consisting mainly of MgO, and subjected to a final finish annealing comprised of secondary recrystallization annealing and purification annealing to obtain a product.

The magnetic properties, surface properties and ratio of poor secondary recrystallized portion in widthwise direction of the thus obtained product were measured to obtain results shown in Table 8.

magnetic properties in the longitudinal direction is excellent.

EXAMPLE 9

(a) Continuously cast slab comprising C: 0.042%, Si: 3.34%, Mn: 0.062%, Se: 0.021%, Sb: 0.025% and the remainder being substantially Fe.

(b) Continuously cast slab comprising C: 0.052%, Si: 3.04%, Mn: 0.070%, Se: 0.023%, Al: 0.025%, N: 0.0077% and the remainder being substantially Fe.

Each of the above slabs was placed in a heating furnace, soaked in an $N_2$ atmosphere, and immediately subjected to a rough rolling to obtain a sheet bar of 30 mm in thickness, which was hot rolled in a tandem mill to obtain a hot rolled steel sheet of 2.0 mm in thickness. The rough rolling conditions and conditions of first pass in the finish rolling are shown in Table 9.

The hot rolled steel sheet was pickled and subjected to first cold rolling and intermediate annealing and further to second cold rolling to obtain a cold rolled steel sheet having a final thickness of 0.23 mm. The sheet was subjected to decarburization annealing, coated with a slurry of an annealing separator consisting mainly of MgO, and subjected to final finish annealing comprised of secondary recrystallization annealing and purification annealing to obtain a product.

The magnetic properties, surface properties and ratio of poor secondary recrystallized portion in widthwise direction of the thus obtained product were measured to obtain results shown in Table 9.

TABLE 8

| No. | Slab heating temperature (°C.) | First pass of rough rolling: temperature $T_1$ (°C.) | First pass of rough rolling: draft $R_1$ (%) | First pass of rough rolling: interval time between passes (s) | Final pass of rough rolling: temperature $T_2$ (°C.) | Final pass of rough rolling: draft $R_2$ (%) | Magnetic properties: $B_8$ (T) | Magnetic properties: $W_{17/50}$ (W/kg) | Ratio of spill generated (%) | Ratio of abnormal grains in widthwise direction (%) | Remarks |
|---|---|---|---|---|---|---|---|---|---|---|---|
| 1 | 1431 | 1344 | 23 | 37 | 1242 | 41 | 1.934 | 0.861 | 0.21 | 0.21 | acceptable example |
| 2 | 1421 | 1283 | 47 | 69 | 1218 | 57 | 1.938 | 0.864 | 0.41 | 0.25 | acceptable example |
| 3 | 1401 | 1293 | 41 | 14* | 1168* | 32* | 1.914 | 0.903 | 1.21 | 3.72 | comparative example |
| 4 | 1366 | 1244* | 54 | 51 | 1214 | 46 | 1.909 | 0.899 | 1.74 | 2.34 | comparative example |

*outside scope of the invention

As seen from Table 8, when the rough rolling is carried out at a high temperature and a large draft according to the invention, the secondary recrystallization uniformly proceeds in the widthwise direction to provide improved magnetic properties, and also the surface properties are good and further the uniformity of the TABLE 9(a)

| No. | Slab composition | Slab heating temperature (°C.) | First pass of rough rolling: temperature $T_1$ (°C.) | First pass of rough rolling: draft $R_1$ (%) | First pass of rough rolling: interval time between passes (s) | Final pass of rough rolling: temperature $T_2$ (°C.) | Final pass of rough rolling: draft $R_2$ (%) | Final pass of rough rolling: final temperature (°C.) | First pass of finish rolling: draft (%) | First pass of finish rolling: temperature (°C.) |
|---|---|---|---|---|---|---|---|---|---|---|
| 1 | a | 1435 | 1363 | 59 | 43 | 1228 | 47 | 1225 | 57 | 948 |
| 2 | a | 1375 | 1283 | 31 | 78 | 1266 | 53 | 1251 | 52 | 935 |
| 3 | a | 1433 | 1348 | 36 | 110 | 1215 | 53 | 1208 | 44 | 967 |
| 4 | a | 1421 | 1352 | 51 | 64 | 1248 | 59 | 1238 | 56 | 913 |
| 5 | a | 1442 | 1330 | 31 | 71 | 1208 | 59 | 1202 | 64 | 943 |
| 6 | a | 1395 | 1305 | 24 | 75 | 1209 | 68 | 1205 | 45 | 972 |
| 7 | a | 1433 | 1348 | 36 | 110 | 1215 | 53 | 1208 | 44 | 967 |
| 8 | a | 1442 | 1330 | 31 | 71 | 1208 | 59 | 1202 | 64 | 943 |
| 9 | a | 1421 | 1352 | 51 | 64 | 1248 | 59 | 1238 | 56 | 913 |
| 10 | a | 1385 | 1311 | 56 | 36 | 1228 | 60 | 1225 | 57 | 948 |
| 11 | a | 1423 | 1341 | 48 | 45 | 1249 | 45 | 1238 | 56 | 913 |
| 12 | a | 1390 | 1328 | 39 | 59 | 1202 | 46 | 1200 | 45 | 972 |
| 13 | a | 1410 | 1337 | 20 | 95 | 1245 | 67 | 1238 | 56 | 913 |

TABLE 9(b)

| No. | Holding time at 1000–850° C. when rolling under conditions according to the invention | Magnetic properties $B_8$ (T) | Magnetic properties $W_{17/50}$ (W/kg) | Ratio of spill generated (%) | Ratio of abnormal grains in widthwise direction (%) | Remarks |
|---|---|---|---|---|---|---|
| 1 | 4 | 1.927 | 0.818 | 0.30 | 0.12 | acceptable example |
| 2 | 7 | 1.926 | 0.824 | 0.31 | 0.25 | acceptable example |
| 3 | 4 | 1.929 | 0.820 | 0.24 | 0.21 | acceptable example |
| 4 | 7 | 1.929 | 0.819 | 0.27 | 0.17 | acceptable example |
| 5 | 5 | 1.926 | 0.828 | 0.24 | 0.18 | acceptable example |
| 6 | 3 | 1.936 | 0.818 | 0.29 | 0.24 | acceptable example |
| 7 | 4 | 1.928 | 0.828 | 0.24 | 0.21 | acceptable example |
| 8 | 5 | 1.926 | 0.826 | 0.24 | 0.18 | acceptable example |
| 9 | 7 | 1.929 | 0.825 | 0.27 | 0.17 | acceptable example |
| 10 | 4 | 1.930 | 0.821 | 0.31 | 0.14 | acceptable example |
| 11 | 7 | 1.926 | 0.829 | 0.22 | 0.20 | acceptable example |
| 12 | 3 | 1.928 | 0.822 | 0.26 | 0.23 | acceptable example |
| 13 | 7 | 1.937 | 0.811 | 0.24 | 0.19 | acceptable example |

TABLE 9(c)

| | | | First pass of rough rolling | | | Final pass of rough rolling | | | First pass of finish rolling | |
|---|---|---|---|---|---|---|---|---|---|---|
| No. | Slab composition | Slab heating temperature (°C.) | temperature $T_1$ (°C.) | draft $R_1$ (%) | interval time between passes (s) | temperature $T_2$ (°C.) | draft $R_2$ (%) | final temperature (°C.) | draft (%) | temperature (°C.) |
| 14 | a | 1395 | 1305 | 24 | 75 | 1209 | 68 | 1205 | 45 | 972 |
| 15 | a | 1405 | 1302 | 42 | 55 | 1237 | 50 | 1225 | 57 | 948 |
| 16 | a | 1375 | 1283 | 31 | 78 | 1266 | 53 | 1251 | 52 | 935 |
| 17 | a | 1380 | 1281 | 58 | 50 | 1251 | 45 | 1238 | 56 | 913 |
| 18 | a | 1388 | 1246* | 24* | 35 | 1167* | 40 | 1151* | 52 | 935 |
| 19 | a | 1370 | 1285 | 63* | 32 | 1140* | 55 | 1139* | 48 | 910 |
| 20 | a | 1365 | 1196* | 58* | 25* | 1134* | 28* | 1111* | 38* | 845* |
| 21 | a | 1366 | 1185* | 42* | 33 | 1084* | 30* | 1066* | 38* | 856 |
| 22 | b | 1375 | 1283 | 31 | 78 | 1266 | 53 | 1247 | 45 | 903 |
| 23 | b | 1395 | 1305 | 24 | 75 | 1209 | 68 | 1173 | 43 | 889 |
| 24 | b | 1385 | 1311 | 56 | 36 | 1228 | 60 | 1214 | 51 | 923 |
| 25 | b | 1442 | 1330 | 31 | 71 | 1208 | 59 | 1178 | 48 | 932 |
| 26 | b | 1423 | 1341 | 48 | 45 | 1249 | 45 | 1231 | 63 | 968 |
| 27 | b | 1365 | 1196* | 58* | 25* | 1134* | 28* | 1162 | 50 | 832* |
| 28 | b | 1440 | 1323 | 44 | 24* | 1210 | 47 | 1160 | 42 | 863 |

TABLE 9(d)

| No. | Holding time at 1000–850° C. when rolling under conditions according to the invention | Magnetic properties $B_8$ (T) | Magnetic properties $W_{17/50}$ (W/kg) | Ratio of spill generated (%) | Ratio of abnormal grains in widthwise direction (%) | Remarks |
|---|---|---|---|---|---|---|
| 14 | 3 | 1.934 | 0.815 | 0.29 | 0.24 | acceptable example |
| 15 | 4 | 1.929 | 0.828 | 0.27 | 0.27 | acceptable example |
| 16 | 7 | 1.934 | 0.822 | 0.31 | 0.25 | acceptable example |
| 17 | 7 | 1.931 | 0.824 | 0.19 | 0.28 | acceptable example |
| 18 | 7 | 1.886 | 0.943 | 3.27 | 3.15 | comparative example |
| 19 | 5 | 1.880 | 0.891 | 1.67 | 2.24 | comparative example |
| 20 | — | 1.878 | 0.918 | 1.77 | 2.77 | comparative example |
| 21 | 1.5* | 1.873 | 0.906 | 2.24 | 4.26 | comparative example |
| 22 | 4 | 1.937 | 0.821 | 0.31 | 0.25 | acceptable example |
| 23 | 3 | 1.939 | 0.813 | 0.29 | 0.24 | acceptable example |
| 24 | 5 | 1.936 | 0.818 | 0.31 | 0.14 | acceptable example |
| 25 | 6 | 1.938 | 0.821 | 0.24 | 0.18 | acceptable example |
| 26 | 4 | 1.930 | 0.817 | 0.22 | 0.20 | acceptable example |
| 27 | — | 1.872 | 0.917 | 1.77 | 2.77 | comparative example |
| 28 | 1.5* | 1.887 | 0.891 | 0.45 | 3.24 | comparative example |

*outside scope of the invention

As seen from the above Table, when the rough rolling and the finish rolling are carried out according to the invention, the magnetic properties and the surface properties are excellent.

EXAMPLE 10

(c) Continuously cast slab comprising C: 0.041%, Si: 3.18%, Mn: 0.058%, Se: 0.022%, Sb: 0.023%, Mo: 0.020% and the remainder being substantially Fe.

(d) Continuously cast slab comprising C: 0.040%, Si: 3.32%, Mn: 0.056%, Se: 0.020%, Sn: 0.081% and the remainder being substantially Fe.

(e) Continuously cast slab comprising C: 0.041%, Si: 3.33%, Mn: 0.058%, Se: 0.021%, Sb: 0.025%, As: 0.019% and the remainder being substantially Fe.

(f) Continuously cast slab comprising C: 0.042%, Si: 3.28%, Mn: 0.055%, Se: 0.023%, Sb: 0.025%, Cu: 0.05% and the remainder being substantially Fe.

(g) Continuously cast slab comprising C: 0.039%, Si: 3.33%, Mn: 0.059%, Se: 0.021%, Sb: 0.023%, Bi: 0.03% and the remainder being substantially Fe.

(h) Continuously cast slab comprising C: 0.041%, Si: 3.35%, Mn: 0.060%, Se: 0.024% and the remainder being substantially Fe.

(i) Continuously cast slab comprising C: 0.038%, Si: 3.08%, Mn: 0.067%, Se: 0.024%, Sb: 0.024%, Al: 0.022%, N: 0.007% and the remainder being substantially Fe.

(j) Continuously cast slab comprising C: 0.041%, Si: 3.17%, Mn: 0.059%, Se: 0.022%, Sb: 0.025%, Al: 0.024%, N: 0.007%, Mo: 0.023% and the remainder being substantially Fe.

(k) Continuously cast slab comprising C: 0.040%, Si: 3.35%, Mn: 0.061%, Se: 0.020%, Sb: 0.023%, Al: 0.021%, N: 0.007%, Sn: 0.084% and the remainder being substantially Fe.

(l) Continuously cast slab comprising C: 0.041%, Si: 3.34%, Mn: 0.058%, Se: 0.022%, Sb: 0.025%, Al: 0.023%, N: 0.008%, As: 0.023% and the remainder being substantially Fe.

(m) Continuously cast slab comprising C: 0.039%, Si: 3.35%, Mn: 0.062%, Se: 0.023%, Sb: 0.023%, Al: 0.021%, N: 0.009%, Cu: 0.05% and the remainder being substantially Fe.

(n) Continuously cast slab comprising C: 0.040%, Si: 3.37%, Mn: 0.052%, Se: 0.020%, Sb: 0.026%, Al: 0.027%, N: 0.007%, Bi: 0.03% and the remainder being substantially Fe.

Each of the above slabs was placed in a heating furnace, soaked in an $N_2$ atmosphere, and immediately subjected to a rough rolling to obtain a sheet bar of 30 mm in thickness, which was hot rolled in a tandem mill to obtain a hot rolled steel sheet of 2.0 mm in thickness. The rough rolling conditions and conditions of first pass in the finish rolling are shown in Table 10.

The hot rolled steel sheet was pickled and subjected to first cold rolling and intermediate annealing and further to second cold rolling to obtain a cold rolled steel sheet having a final thickness of 0.23 mm. The sheet was subjected to decarburization annealing, coated with a slurry of an annealing separator consisting mainly of MgO, and subjected to final finish annealing comprised of secondary recrystallization annealing and purification annealing to obtain a product.

The magnetic properties, surface properties and ratio of poor secondary recrystallized portion in widthwise direction of the thus obtained product were measured to obtain results shown in Table 10. In any slab compositions, the products obtained according to the invention are excellent as compared with the comparative examples.

TABLE 10(a)

| | | | First pass of rough rolling | | | Final pass of rough rolling | | | First pass of finish rolling | |
|---|---|---|---|---|---|---|---|---|---|---|
| No. | Slab composition | Slab heating temperature (°C.) | temperature $T_1$ (°C.) | draft $R_1$ (%) | interval time between passes (s) | temperature $T_2$ (°C.) | draft $R_2$ (%) | final temperature (°C.) | draft (%) | temperature (°C.) |
| 29 | c | 1423 | 1341 | 48 | 45 | 1249 | 45 | 1235 | 54 | 948 |
| 30 | c | 1395 | 1305 | 24 | 75 | 1209 | 68 | 1208 | 46 | 867 |
| 31 | c | 1440 | 1323 | 44 | 24* | 1210 | 47 | 1208 | 45 | 866 |
| 32 | d | 1433 | 1348 | 36 | 110 | 1215 | 53 | 1208 | 46 | 867 |
| 33 | d | 1395 | 1305 | 24 | 75 | 1209 | 68 | 1174 | 46 | 890 |
| 34 | d | 1388 | 1246* | 24* | 35 | 1167 | 40 | 1146* | 58 | 904 |
| 35 | e | 1433 | 1348 | 36 | 110 | 1215 | 53 | 1202 | 63 | 943 |
| 36 | e | 1390 | 1328 | 39 | 59 | 1202 | 46 | 1179 | 49 | 933 |
| 37 | e | 1365 | 1196* | 58* | 25* | 1134* | 28* | 1114* | 38* | 904 |
| 38 | f | 1385 | 1311 | 56 | 36 | 1228 | 60 | 1173 | 45 | 889 |
| 39 | f | 1435 | 1363 | 59 | 43 | 1228 | 47 | 1209 | 47 | 868 |
| 40 | f | 1388 | 1246* | 24* | 35 | 1167 | 40 | 1146* | 58 | 904 |
| 41 | g | 1405 | 1302 | 42 | 55 | 1237 | 50 | 1178 | 48 | 932 |
| 42 | g | 1395 | 1305 | 24 | 75 | 1209 | 68 | 1203 | 64 | 944 |
| 43 | g | 1408 | 1291 | 33 | 26* | 1208 | 50 | 1145* | 46 | 890 |
| 44 | h | 1421 | 1352 | 51 | 64 | 1258 | 59 | 1253 | 55 | 940 |
| 45 | h | 1405 | 1302 | 42 | 55 | 1237 | 50 | 1231 | 54 | 950 |
| 46 | h | 1370 | 1285 | 63* | 32 | 1140* | 32 | 1116* | 35* | 920 |

TABLE 10(b)

| No. | Holding time at 1000–850° C. when rolling under conditions according to the invention | Magnetic properties $B_8$ (T) | Magnetic properties $W_{17/50}$ (W/kg) | Ratio of spill generated (%) | Ratio of abnormal grains in widthwise direction (%) | Remarks |
|---|---|---|---|---|---|---|
| 29 | 4 | 1.927 | 0.828 | 0.22 | 0.20 | acceptable example |
| 30 | 4 | 1.929 | 0.819 | 0.29 | 0.24 | acceptable example |
| 31 | 1.4* | 1.884 | 0.897 | 0.45 | 3.24 | comparative example |
| 32 | 4 | 1.933 | 0.813 | 0.24 | 0.21 | acceptable example |
| 33 | 3 | 1.929 | 0.822 | 0.29 | 0.24 | acceptable example |
| 34 | 3 | 1.886 | 0.943 | 3.27 | 3.15 | comparative example |
| 35 | 5 | 1.928 | 0.831 | 0.24 | 0.21 | acceptable example |
| 36 | 7 | 1.926 | 0.820 | 0.26 | 0.23 | acceptable example |
| 37 | 7 | 1.883 | 0.900 | 1.77 | 2.77 | comparative example |
| 38 | 3 | 1.925 | 0.825 | 0.31 | 0.14 | acceptable example |
| 39 | 5 | 1.927 | 0.822 | 0.30 | 0.12 | acceptable example |
| 40 | 21* | 1.886 | 0.878 | 3.27 | 3.15 | comparative example |
| 41 | 6 | 1.929 | 0.823 | 0.27 | 0.27 | acceptable example |
| 42 | 5 | 1.938 | 0.816 | 0.29 | 0.24 | acceptable example |
| 43 | 4 | 1.892 | 0.905 | 2.68 | 3.42 | comparative example |
| 44 | 3 | 1.931 | 0.825 | 0.27 | 0.17 | acceptable example |
| 45 | 6 | 1.928 | 0.820 | 0.28 | 0.28 | acceptable example |
| 46 | 4 | 1.880 | 0.900 | 1.67 | 2.24 | comparative example |

TABLE 10(c)

| No. | Slab composition | Slab heating temperature (°C.) | First pass of rough rolling: temperature $T_1$ (°C.) | draft $R_1$ (%) | interval time between passes (s) | Final pass of rough rolling: temperature $T_2$ (°C.) | draft $R_2$ (%) | final temperature (°C.) | First pass of finish rolling: draft (%) | temperature (°C.) |
|---|---|---|---|---|---|---|---|---|---|---|
| 47 | i | 1421 | 1352 | 51 | 64 | 1258 | 59 | 1252 | 60 | 938 |
| 48 | i | 1385 | 1311 | 56 | 36 | 1228 | 60 | 1177 | 47 | 931 |
| 49 | i | 1440 | 1323 | 44 | 24* | 1255 | 47 | 1250 | 43 | 923 |
| 50 | j | 1375 | 1283 | 31 | 78 | 1266 | 53 | 1245 | 54 | 947 |
| 51 | j | 1435 | 1363 | 59 | 43 | 1228 | 47 | 1211 | 52 | 913 |
| 52 | j | 1440 | 1323 | 44 | 24* | 1260 | 42 | 1241 | 50 | 834* |
| 63 | k | 1421 | 1352 | 51 | 64 | 1248 | 59 | 1232 | 50 | 891 |
| 54 | k | 1385 | 1311 | 56 | 36 | 1228 | 60 | 1172 | 44 | 888 |
| 55 | k | 1408 | 1291 | 33 | 26* | 1228 | 50 | 1222 | 40 | 942 |
| 56 | l | 1400 | 1297 | 44 | 53 | 1237 | 50 | 1230 | 53 | 949 |
| 57 | l | 1390 | 1300 | 44 | 51 | 1233 | 52 | 1200 | 63 | 943 |
| 58 | l | 1410 | 1293 | 32 | 26* | 1258 | 50 | 1245 | 35* | 910 |
| 59 | m | 1442 | 1330 | 31 | 71 | 1238 | 56 | 1210 | 51 | 912 |
| 60 | m | 1423 | 1341 | 48 | 45 | 1249 | 45 | 1230 | 49 | 890 |
| 61 | m | 1408 | 1283 | 40 | 14* | 1254 | 45 | 1244 | 35* | 908 |
| 62 | n | 1410 | 1337 | 20 | 95 | 1245 | 67 | 1192 | 52 | 939 |
| 63 | n | 1405 | 1302 | 42 | 55 | 1237 | 50 | 1202 | 63 | 943 |
| 64 | n | 1440 | 1323 | 44 | 24* | 1255 | 44 | 1240 | 43 | 948 |

TABLE 10(d)

| No. | Holding time at 1000–850° C. when rolling under conditions according to the invention | Magentic properties: $B_8$ (T) | $W_{17/50}$ (W/kg) | Ratio of spill generated (%) | Ratio of abnormal grains in widthwise direction (%) | Remarks |
|---|---|---|---|---|---|---|
| 47 | 4 | 1.939 | 0.827 | 0.27 | 0.17 | acceptable example |
| 48 | 5 | 1.941 | 0.823 | 0.31 | 0.14 | acceptable example |
| 49 | 12* | 1.881 | 0.920 | 0.45 | 3.24 | comparative example |
| 50 | 4 | 1.938 | 0.816 | 0.30 | 0.24 | acceptable example |
| 51 | 4 | 1.942 | 0.820 | 0.30 | 0.12 | acceptable example |
| 52 | 1.6* | 1.891 | 0.903 | 0.50 | 3.20 | comparative example |
| 53 | 4 | 1.936 | 0.816 | 0.28 | 0.18 | acceptable example |
| 54 | 3 | 1.943 | 0.824 | 0.26 | 0.26 | acceptable example |
| 55 | 21* | 1.881 | 0.936 | 1.77 | 4.26 | comparative example |
| 56 | 5 | 1.938 | 0.818 | 0.24 | 0.31 | acceptable example |
| 57 | 6 | 1.939 | 0.826 | 0.26 | 0.23 | acceptable example |
| 58 | 4 | 1.885 | 0.889 | 2.66 | 3.44 | comparative example |
| 59 | 3 | 1.936 | 0.825 | 0.22 | 0.19 | acceptable example |
| 60 | 4 | 1.939 | 0.822 | 0.20 | 0.22 | acceptable example |
| 61 | 5 | 1.878 | 0.941 | 1.15 | 3.54 | comparative example |
| 62 | 5 | 1.941 | 0.821 | 0.24 | 0.19 | acceptable example |
| 62 | 5 | 1.939 | 0.820 | 0.28 | 0.28 | acceptable example |
| 64 | 21* | 1.883 | 0.926 | 1.77 | 3.24 | comparative example |

*outside scope of the invention

EXAMPLE 11

A continuously cast slab comprising C: 0.034%, Si: 3.01%, Mn: 0.070%, S: 0.017% and the remainder being substantially Fe was placed in a heating furnace, soaked in an $N_2$ atmosphere, and subjected to a rough rolling under conditions shown in Table 11 immediately after the soaking, whereby a sheet bar of 35 mm in thickness was obtained. Thereafter, the sheet bar was subjected to a finish tandem rolling under conditions shown in the same Table 11 to obtain a hot rolled steel sheet of 2.4 mm in thickness.

The hot rolled steel sheet was pickled and subjected to first cold rolling—intermediate annealing —second cold rolling to obtain a cold rolled sheet of 0.35 mm in thickness. Then, the sheet was subjected to decarburization annealing, coated with MgO, and subjected to a final finish annealing comprised of secondary recrystallization annealing and purification annealing to obtain a product.

The magnetic properties, surface properties and ratio of poor secondary recrystallized portion in widthwise direction of the thus obtained product were measured to obtain results shown in Table 11.

TABLE 11(a)

| No. | Slab heating temperature (°C.) | First pass of rough rolling: temperature $T_1$ (°C.) | draft $R_1$ (%) | interval time between passes (s) | Final pass of rough rolling: temperature $T_2$ (°C.) | draft $R_2$ (%) | final temperature (°C.) | First pass of finish rolling: draft (%) | temperature (°C.) |
|---|---|---|---|---|---|---|---|---|---|
| 1 | 1437 | 1343 | 52 | 31 | 1232 | 44 | 1225 | 57 | 948 |
| 2 | 1381 | 1285 | 45 | 44 | 1208 | 55 | 1202 | 64 | 943 |
| 3 | 1367 | 1242* | 53 | 63 | 1182* | 45 | 1218 | 45 | 946 |

TABLE 11(b)

| No. | Holding time at 1000–850° C. when rolling under conditions according to the invention | Magentic properties $B_8$ (T) | $W_{17/50}$ (W/kg) | Ratio of spill generated (%) | Ratio of abnormal grains in widthwise direction (%) | Remarks |
|---|---|---|---|---|---|---|
| 1 | 4 | 1.885 | 1.259 | 0.42 | 0.11 | acceptable example |
| 2 | 5 | 1.881 | 1.261 | 0.38 | 0.22 | acceptable example |
| 3 | 21* | 1.849 | 1.418 | 1.54 | 2.79 | comparative example |

*outside scope of the invention

As seen from the above Table, when the rough rolling and the finish rolling are carried out according to the invention, not only the magnetic properties and surface properties but also the uniformity of the magnetic properties in the longitudinal direction are excellent.

EXAMPLE 12

(i) Continuously cast slab comprising C: 0.038%, Si: 3.20%, Mn: 0.070%, Se: 0.021% and the remainder being substantially Fe.

(ii) Continuously cast slab comprising C: 0.041%, Si: 3.28%, Mn: 0.065%, Se: 0.017%, Sb: 0.023% and the remainder being substantially Fe.

(iii) Continuously cast slab comprising C: 0.036%, Si: 3.11%, Mn: 0.071%, Se: 0.022%, Al: 0.022%, N: 0.008% and the remainder being substantially Fe.

Each of the above slabs was immediately placed in a gas heating furnace, soaked in an $N_2$ atmosphere, further placed into an induction heating furnace, at where a temperature difference between temperature of central portion being 1430° C. and temperature of surface portion being 1370° C. was sufficiently ensured, and immediately subjected to a rough rolling under conditions shown in Table 12, whereby a sheet bar of 30 mm in thickness was obtained. Moreover, the surface was positively cooled during the rough rolling. Then, the sheet bar was subjected to a finish tandem rolling under conditions shown in the same Table 12 to obtain a hot rolled steel sheet of 2.7 mm in thickness. Prior to the finish rolling, the surface of the sheet bar was sufficiently cooled with a high pressure water.

The hot rolled steel sheet was pickled, subjected to first cold rolling and intermediate annealing and further to second cold rolling to obtain a cold rolled steel sheet having a final thickness of 0.27 mm. Thereafter, the cold rolled steel sheet was subjected to decarburization annealing, coated with a slurry of an annealing separator consisting mainly of MgO, and then subjected to a final finish annealing comprised of secondary recrystallization annealing and purification annealing to obtain a product.

The magnetic properties of the thus obtained product were measured to obtain results as shown in Table 12.

TABLE 12(a)

| No. | Slab composition | Use method of heating furnace | Slab heating temperature (°C.) | First pass of rough rolling: temperature $T_1$ (°C.) | draft $R_1$ (%) | interval time between passes (s) | Final pass of rough rolling: temperature $T_2$ (°C.) | draft $R_2$ (%) | First pass of finish rolling: draft (%) | temperature of central portion (°C.) | in 1/20 layer: temperature (°C.) | holding time (s) |
|---|---|---|---|---|---|---|---|---|---|---|---|---|
| 1 | i | ○ | 1442 | 1332 | 31 | 71 | 1207 | 59 | 43 | 1154 | 981 | 4 |
| 2 | i | Δ | 1425 | 1341 | 45 | 45 | 1249 | 45 | 50 | 1160 | 995 | 5 |
| 3 | i | ○ | 1415 | 1338 | 23 | 95 | 1245 | 66 | 45 | 1158 | 991 | 6 |
| 4 | i | Δ | 1407 | 1304 | 41 | 55 | 1237 | 49 | 46 | 1160 | 990 | 6 |
| 5 | i | ○ | 1387 | 1282 | 57 | 50 | 1254 | 45 | 47 | 1154 | 972 | 4 |
| 6 | i | ○ | 1366 | 1196* | 58* | 25* | 1133* | 28* | 48 | 1110* | 960 | 3 |
| 7 | i | X | 1370 | 1285 | 63* | 32 | 1140* | 55 | 45 | 1003* | 963 | 4 |
| 8 | ii | ○ | 1433 | 1347 | 36 | 109 | 1215 | 53 | 46 | 1162 | 973 | 5 |
| 9 | ii | Δ | 1442 | 1330 | 30 | 71 | 1207 | 58 | 50 | 1170 | 980 | 4 |
| 10 | ii | ○ | 1423 | 1352 | 51 | 64 | 1249 | 59 | 53 | 1159 | 990 | 4 |
| 11 | ii | Δ | 1406 | 1302 | 41 | 54 | 1237 | 50 | 49 | 1172 | 965 | 4 |
| 12 | ii | ○ | 1411 | 1338 | 20 | 95 | 1245 | 67 | 48 | 1153 | 995 | 5 |
| 13 | ii | Δ | 1408 | 1291 | 33 | 26* | 1208 | 50 | 49 | 1160 | 953 | 1* |
| 14 | ii | ○ | 1410 | 1196* | 58* | 25* | 1134* | 28* | 62 | 1105* | 998 | 5 |
| 15 | iii | ○ | 1433 | 1349 | 36 | 110 | 1215 | 53 | 50 | 1172 | 973 | 6 |
| 16 | iii | Δ | 1421 | 1352 | 50 | 64 | 1248 | 59 | 50 | 1168 | 980 | 4 |
| 17 | iii | ○ | 1390 | 1328 | 40 | 59 | 1202 | 46 | 51 | 1167 | 990 | 3 |
| 18 | iii | Δ | 1406 | 1302 | 42 | 55 | 1237 | 50 | 48 | 1162 | 980 | 4 |
| 19 | iii | ○ | 1423 | 1341 | 48 | 45 | 1248 | 46 | 49 | 1159 | 966 | 5 |
| 20 | iii | Δ | 1388 | 1246* | 25* | 35 | 1267 | 52 | 50 | 1180 | 1006* | — |
| 21 | iii | X | 1370 | 1196* | 58* | 25* | 1134* | 51 | 51 | 1020* | 945* | — |

Use method of heating furnace
○: gas furnace + induction heating furnace
Δ: only induction heating furnace
X: only gas furnace
*outside scope of the invention TABLE 12(b)

| No. | At central temperature of 950–850° C.: cumulative draft (%) | holding time (s) | Magnetic properties $B_8$ (T) | $W_{17/50}$ (W/kg) | Ratio of spill generated (%) | Ratio of abnormal grains in widthwise direction (%) | Remarks |
|---|---|---|---|---|---|---|---|
| 1 | 44 | 3 | 1.928 | 0.895 | 0.21 | 0.19 | acceptable example |
| 2 | 43 | 4 | 1.930 | 0.897 | 0.23 | 0.19 | acceptable example |
| 3 | 55 | 3 | 1.929 | 0.899 | 0.24 | 0.20 | acceptable example |

TABLE 12(b)-continued

| No. | At central temperature of 950–850° C. cumulative draft (%) | holding time (s) | Magnetic properties $B_8$ (T) | $W_{17/50}$ (W/kg) | Ratio of spill generated (%) | Ratio of abnormal grains in widthwise direction (%) | Remarks |
|---|---|---|---|---|---|---|---|
| 4 | 58 | 5 | 1.932 | 0.891 | 0.25 | 0.24 | acceptable example |
| 5 | 52 | 5 | 1.931 | 0.900 | 0.18 | 0.28 | acceptable example |
| 6 | 45 | 7 | 1.895 | 1.031 | 2.24 | 3.15 | comparative example |
| 7 | 54 | 4 | 1.892 | 1.001 | 2.60 | 3.20 | comparative example |
| 8 | 48 | 5 | 1.934 | 0.899 | 0.27 | 0.21 | acceptable example |
| 9 | 55 | 5 | 1.935 | 0.893 | 0.27 | 0.21 | acceptable example |
| 10 | 65 | 4 | 1.933 | 0.899 | 0.24 | 0.20 | acceptable example |
| 11 | 64 | 3 | 1.931 | 0.904 | 0.20 | 0.17 | acceptable example |
| 12 | 43 | 3 | 1.929 | 0.903 | 0.21 | 0.20 | acceptable example |
| 13 | 54 | 3 | 1.872 | 1.002 | 2.69 | 2.98 | comparative example |
| 14 | 55 | 3 | 1.870 | 1.009 | 2.72 | 3.03 | comparative example |
| 15 | 45 | 4 | 1.939 | 0.932 | 0.30 | 0.21 | acceptable example |
| 16 | 63 | 3 | 1.948 | 0.947 | 0.24 | 0.18 | acceptable example |
| 17 | 55 | 4 | 1.940 | 0.921 | 0.27 | 0.14 | acceptable example |
| 18 | 65 | 5 | 1.948 | 0.922 | 0.29 | 0.20 | acceptable example |
| 19 | 51 | 5 | 1.936 | 0.923 | 0.31 | 0.24 | acceptable example |
| 20 | 56 | 5 | 1.870 | 1.110 | 2.85 | 3.15 | comparative example |
| 21 | 71 | 3 | 1.865 | 1.120 | 2.84 | 2.77 | comparative example |

As seen from Table 12, when the rough rolling is carried out at a high temperature and a large draft and then the first pass of the finish rolling is carried out under such conditions that the draft is not less than 40% at the temperature of the 1/20 layer of 1000° C.–950° C. and this temperature is held for 3–20 seconds and further the working strain at a draft of not less than 40% is applied at the temperature of the central portion of 950° C.–850° C. and this temperature is held for 2–20 seconds, the improved magnetic properties are stably obtained.

In Table 12 is also shown a case using no induction heating furnace. In this case, it is very difficult to take the temperature difference and the temperature difference between the surface layer and the central portion hardly ensures, so that the properties become not stable.

EXAMPLE 13

A continuously cast slab comprising C: 0.043%, Si: 3.41%, Mn: 0.072%, Se: 0.020%, Sb: 0.020% and the remainder being substantially Fe was immediately placed in a gas heating furnace, soaked in an $N_2$ atmosphere render the temperature of central portion into 1370° C. and the temperature of surface layer portion into 1410° C., and immediately subjected to a rough rolling under conditions shown in Table 13, whereby a sheet bar of 30 mm in thickness was obtained. Then, the sheet bar was subjected to a finish tandem rolling under conditions shown in Table 13 to obtain a hot rolled steel sheet of 2.0 mm in thickness.

On the other hand, the continuously cast slab having the above composition was immediately placed in a gas heating furnace, soaked in an $N_2$ atmosphere, further placed into an induction heating furnace, at where a temperature difference between temperature of central portion being 1430° C. and temperature of surface portion being 1370° C. was sufficiently ensured, and subjected to a rough rolling and finish rolling under conditions shown in Table 13, whereby a hot rolled steel sheet of 2.0 mm in thickness was obtained. Moreover, the surface was positively cooled during the rough rolling.

These hot rolled steel sheets were pickled, subjected to first cold rolling and intermediate annealing and further to second cold rolling to obtain a cold rolled steel sheet having a final thickness of 0.23 mm. Thereafter, the cold rolled steel sheets were subjected to decarburization diannealing, coated with a slurry of an annealing separator consisting mainly of MgO, and then subjected to a final finish annealing comprised of secondary recrystallization annealing and purification annealing to obtain products.

The magnetic properties of the thus obtained products were measured to obtain results as shown in Table 13.

In Table 13 are also shown results measured on a case that the temperature of the decarburization annealing at the above steps is shifted to 20° C. higher than the optimum temperature.

From this table, it is understood that when the inhibitor in the hot rolled sheet is controlled at the direction of sheet thickness, the magnetic properties can stably be improved even in the change of treating conditions frequently generated in the actual running line.

TABLE 13(a)

| No. | Slab heating temperature (°C.) | First pass of rough rolling temperature $T_1$ (°C.) | draft $R_1$ (%) | interval time between passes (s) | Final pass of rough rolling temperature $T_2$ (°C.) | draft $R_2$ (%) | First pass of finish rolling draft (%) | temperature of central portion (°C.) | in 1/20 layer temperature (°C.) | holding time (s) |
|---|---|---|---|---|---|---|---|---|---|---|
| 1 | 1436 | 1348 | 36 | 110 | 1215 | 53 | 58 | 1160 | 983 | 5 |
| 2 | 1442 | 1331 | 30 | 70 | 1208 | 59 | 48 | 1155 | 974 | 4 |
| 3 | 1432 | 1341 | 48 | 45 | 1249 | 45 | 58 | 1167 | 960 | 7 |
| 4 | 1416 | 1337 | 20 | 75 | 1245 | 67 | 53 | 1158 | 970 | 4 |
| 5 | 1405 | 1305 | 24 | 75 | 1209 | 68 | 60 | 1159 | 981 | 5 |
| 6 | 1424 | 1340 | 47 | 45 | 1249 | 45 | 55 | 1000 | 996 | 6 |
| 7 | 1410 | 1337 | 20 | 95 | 1245 | 65 | 48 | 989 | 960 | 4 |
| 8 | 1377 | 1196* | 58* | 25* | 1134* | 28* | 51 | 995 | 965 | 5 |

TABLE 13(a)-continued

| No. | Slab heating temperature (°C.) | First pass of rough rolling temperature $T_1$ (°C.) | First pass of rough rolling draft $R_1$ (%) | First pass of rough rolling interval time between passes (s) | Final pass of rough rolling temperature $T_2$ (°C.) | Final pass of rough rolling draft $R_2$ (%) | First pass of finish rolling draft (%) | First pass of finish rolling temperature of central portion (°C.) | First pass of finish rolling in 1/20 layer temperature (°C.) | First pass of finish rolling in 1/20 layer holding time (s) |
|---|---|---|---|---|---|---|---|---|---|---|
| 9 | 1380 | 1246* | 24* | 35 | 1267 | 40 | 48 | 950 | 917 | 3 |

*outside scope of the invention

TABLE 13(b)

| No. | At central temperature of 950–850° C. cumulative draft (%) | At central temperature of 950–850° C. holding time (s) | Magnetic properties $B_8$ (T) | Magnetic properties $W_{17/50}$ (W/kg) | Ratio of spill generated (%) | Ratio of abnormal grains in widthwise direction (%) | Ratio of achieving $B_8$ of not more than 1.90 T when decarburization annealing is carried out at a temperature higher by 20° C. |
|---|---|---|---|---|---|---|---|
| 1 | 51 | 4 | 1.936 | 0.813 | 0.25 | 0.13 | 10 |
| 2 | 63 | 3 | 1.931 | 0.820 | 0.28 | 0.17 | 9 |
| 3 | 54 | 5 | 1.937 | 0.824 | 0.21 | 0.20 | 11 |
| 4 | 53 | 4 | 1.933 | 0.819 | 0.25 | 0.23 | 8 |
| 5 | 52 | 3 | 1.935 | 0.819 | 0.24 | 0.27 | 7 |
| 6 | — | — | 1.926 | 0.827 | 0.25 | 0.25 | 53 |
| 7 | — | — | 1.929 | 0.830 | 0.27 | 0.17 | 61 |
| 8 | — | — | 1.910 | 0.910 | 3.42 | 3.32 | 95 |
| 9 | — | — | 1.908 | 0.905 | 2.98 | 3.55 | 91 |

INDUSTRIAL APPLICABILITY

According to the invention, grain oriented silicon steel sheets having improved magnetic properties over a whole of the steel sheet and good surface properties can stably be produced.

Furthermore, according to the invention, the merits of the hot strip mill can be utilized at maximum in the production of the grain oriented silicon steel sheet, so that not only the improvement of the productivity but also the energy-saving can be achieved.

We claim:

1. A method of producing a grain oriented silicon steel sheet having improved magnetic properties wherein a slab of silicon-containing steel, after heating, is subjected to hot rolling comprising the steps of: rough rolling at a temperature within a region exceeding 1150° C. and subsequent finish rolling said steel sheet, subjecting said steel sheet to heavy cold rolling or cold rolling two times through intermediate annealing to a final sheet thickness, subjecting said steel sheet to decarburization annealing, applying a slurry of an annealing separator to a surface of said steel sheet, and subjecting said steel sheet to final finish annealing, characterized in that after said rough rolling occurs within a temperature region exceeding 1150° C., said finish rolling is carried out at the temperature of the steel sheet is within a range of 1000°–850° C. at a percent reduction of not less than 40% for 2–20% seconds to precipitate inhibitors in the steel sheet.

2. A method of producing a grain oriented silicon steel sheet having improved magnetic properties wherein a slab of silicon-containing steel, after heating, is subjected to hot rolling comprising the steps of: rough rolling and subsequent finish rolling said steel sheet, subjecting said steel sheet to heavy cold rolling or cold rolling two times through intermediate annealing to a final sheet thickness, subjecting said steel sheet to decarburization annealing, applying a slurry of an annealing separator to a surface of said steel sheet, and subjecting said steel sheet to final finish annealing, characterized in that in the finish hot rolling step, said steel sheet is cooled while holding the temperature in a central portion of said steel sheet in the thickness direction at a value above 1150° C., and when the sheet temperature positioned from the surface at a depth corresponding to 1/20 of the sheet thickness reaches a temperature in the range of 1000°–950° C., the steel sheet is rolled at a present reduction of not less than 40% and held at said temperature range for 3–20 seconds and then cooled, and when a temperature at the central portion of said sheet reaches a central temperature range of 950°–850° C., the steel sheet is rolled at a percent reduction of not less than 40% and held at said central temperature range for 2–20 seconds to precipitate uniformly and finely dispersed inhibitor in the steel sheet.

3. A method of producing a grain oriented silicon steel sheet having improved magnetic properties wherein a slab of silicon-containing steel, after heating, is subjected to hot rolling comprising the steps of rough rolling and subsequent finish rolling said steel sheet, subjecting said steel sheet to a heavy cold rolling or a two-times cold rolling through an intermediate annealing to a final sheet thickness, subjecting said steel sheet to decarburization annealing, applying a slurry of an annealing separator to a surface of said steel sheet, and subjecting said steel sheet to a final finish annealing, characterized in that at said rough rolling step, a first pass is carried out under conditions that a rolling temperature $T_1$ is not lower than 1280° C. and percent reduction $R_1$ satisfies the following equation:

$$60 \geqq R_1(\%) \geqq -0.5T_1 + 670$$

and wherein said steel sheet is held under the above conditions up to a next pass for not less than 30 seconds, and a final pass is carried out under conditions that a rolling temperature $R_2$ is not lower than 1200° C. and percent reduction $R_2$ satisfies the following equation:

$$70 \geqq R_2(\%) \geqq -0.3T_2 + 165.$$

4. A method of producing a grain oriented silicon steel sheet having improved magnetic properties wherein a slab of silicon-containing steel, after heating, is subjected to hot rolling comprising the steps of rough rolling and subsequent finish rolling said steel sheet, subjecting said steel sheet to a heavy cold rolling or a two-times cold rolling through an intermediate annealing to a final sheet thickness, subjecting said steel sheet to decarburization annealing, applying a slurry of an annealing separator to a surface of said steel sheet, and subjecting said steel sheet to a final finish annealing, characterized in that at said rough rolling step, a first pass is carried out under conditions that a rolling temperature $T_1$ is not lower than 1280° C. and percent reduction $R_1$ satisfies the following equation:

$$60 \geqq R_1(\%) \geqq -0.5T_1 + 670$$

and wherein said steel sheet is held under the above conditions up to a next pass for not less than 30 seconds, and a final pass is carried out under conditions that a rolling temperature $T_2$ is not lower than 1200° C. and percent reduction $R_2$ satisfies the following equation:

$$70 \geqq R_2(\%) \geqq -0.3T_2 + 165$$

and then finish rolling is carried out within a temperature range of 1000°-850° C. at a percent reduction of not less than 40% and held at said temperature range for 2-20 seconds.

5. A method of producing a grain oriented silicon steel having improved magnetic properties wherein a slab of silicon-containing steel, after heating, is subjected to hot rolling comprising the steps of rough rolling and subsequent finish rolling said steel sheet, subjecting said steel sheet to a heavy cold rolling or a two-times cold rolling through an intermediate annealing to a final sheet thickness, subjecting said steel sheet to decarburization annealing, applying a slurry of an annealing separator to a surface of said steel sheet, and subjecting said steel sheet to a final finish annealing, characterized in that at said rough rolling step, a first pass is carried out under conditions that a rolling temperature $T_1$ is not lower than 1280° C. and percent reduction $R_1$ satisfies the following equation:

$$60 \geqq R_1(\%) \geqq -0.5T_1 + 670$$

and wherein said steel sheet is held under the above conditions up to a next pass for not less than 30 seconds, and a final pass is carried out under conditions that a rolling temperature $T_2$ is not lower than 1200° C. and percent reduction $R_2$ satisfies the following equation:

$$70 \geqq R_2(\%) \geqq -0.3T_2 + 165$$

and at said subsequent finish rolling stage, said steel sheet is cooled while holding the temperature in a central portion of said steel sheet in the thickness direction above 1150° C., and when the temperature at a depth corresponding to 1/20 of the sheet thickness reaches a temperature range of 1000°-950° C., the steel sheet is rolled at a percent reduction of not less than 40% and held at the above temperature range for 3-20 seconds and then cooled, and when the temperature at the central portion reaches a temperature range of 950°-850° C., the steel sheet is rolled at a present reduction of not less than 40% and held at said temperature range for 2-20 seconds.

6. A method of producing a grain oriented silicon steel sheet in any of claims 1, 2, 3, 4 or 5, wherein the temperatures of heating said slab is not lower than 1370° C. in a central portion of said slab.

7. A method of producing a grain oriented silicon steel sheet having improved magnetic properties wherein a slab of silicon-containing steel, after heating, is subjected to hot rolling comprising the steps of: rough rolling at a temperature within a region exceeding 1150° C., subsequent finish rolling said steel sheet and precipitating uniformly and finely dispersed inhibitor in said steel sheet, subjecting said steel sheet to heavy cold rolling or cold rolling two times through intermediate annealing to a final sheet thickness, subjecting said steel sheet to decarburization annealing applying a slurry of an annealing separator to a surface of said steel sheet, and subjecting said steel sheet to final finish annealing, characterized in that after said rough rolling occurs within a temperature region exceeding 1150° C., said finish rolling is carried out within a temperature range of 1000°-850° C. at a percent reduction of not less than 40% for 2-20 seconds.

* * * * *

UNITED STATES PATENT AND TRADEMARK OFFICE

CERTIFICATE OF CORRECTION

PATENT NO. : 5,296,050

DATED : March 22, 1994

INVENTOR(S) : Takamiya et al.

It is certified that error appears in the above-indentified patent and that said Letters Patent is hereby corrected as shown below:

In Column 4, line 12, please change "$60 \geqq R_1(\%) \geqq 0.5T_1+670$" to --$60 \geqq R_1(\%) \geqq -0.5T_1+670$--;
line 20, please change "$70 \geqq R_2(\%) \geqq 0.1T_2+165$" to --$70 \geqq R_2(\%) \geqq -0.1T_2+165$--;
line 38, please change "$60 \geqq R_1(\%) \geqq 0.5T_1+670$" to --$60 \geqq R_1(\%) \geqq -0.5T_1+670$--;
line 46, please change "$70 \geqq R_2(\%) \geqq 0.1T_2+165$" to --$70 \geqq R_2(\%) \geqq -0.1T_2+165$--; and
line 67, please change "$60-R_1(\%) \geqq 0.5T_1+670$" to --$60 \geqq R_1(\%) \geqq -0.5T_1+670$--.

In Column 14, line 5, please change "Al: 0 005-0.10%, N: 0.004-0.015%" to --Al: 0.005-0.10%, N: 0.004-0.015%--; and
line 27, please change "C: 0.35%," to --C: 0.035%,--.

At Cols. 15 & 16, in Table 1(b), under the heading "Holding time at 1000-850°C. when rolling under conditions according to the invention", second row down, please change "5" to --4--.

At Cols. 33 & 34, in Table 10(d), under the heading "Holding time at 1000-850°C. when rolling under conditions according to the invention", third row down, please change "12*" to --21*--.

In Column 40, line 61, please change "$R_2$" to --$T_2$--; and
line 64, please change "$70 \geqq R_2(\%) \geqq -0.3T_2+165$." to --$70 \geqq R_2(\%) \geqq -0.1T_2+165$.--.

UNITED STATES PATENT AND TRADEMARK OFFICE

CERTIFICATE OF CORRECTION

PATENT NO. : 5,296,050

DATED : March 22, 1994

INVENTOR(S) : Takamiya et al.

It is certified that error appears in the above-indentified patent and that said Letters Patent is hereby corrected as shown below:

In Column 41, line 22, please change "$70 \geqq R_2(\%) \geqq -0.3T_2+165$" to --$70 \geqq R_2(\%) \geqq -0.1T_2+165$--.

In Column 42, line 8, please change "$70 \geqq R_2(\%) \geqq -0.3T_2+165$" to --$70 \geqq R_2(\%) \geqq -0.1T_2+165$--; and
line 37, please change "annealing applying" to --annealing, applying--.

Signed and Sealed this

First Day of November, 1994

*Attest:*

*Attesting Officer*

BRUCE LEHMAN

*Commissioner of Patents and Trademarks*